US009341325B2

(12) United States Patent
Sharrah et al.

(10) Patent No.: US 9,341,325 B2
(45) Date of Patent: May 17, 2016

(54) PORTABLE LIGHT HAVING A SLEEVE INTERNAL THERETO AND SLEEVE THEREFOR

(71) Applicant: Streamlight, Inc., Eagleville, PA (US)

(72) Inventors: Raymond L. Sharrah, Collegeville, PA (US); Cleatis A. Eichelberger, East Norriton, PA (US)

(73) Assignee: Streamlight, Inc., Eagleville, PA (US)

( * ) Notice: Subject to any disclaimer, the term of this patent is extended or adjusted under 35 U.S.C. 154(b) by 0 days.

(21) Appl. No.: 14/623,895

(22) Filed: Feb. 17, 2015

(65) Prior Publication Data

US 2016/0033091 A1 Feb. 4, 2016

Related U.S. Application Data

(63) Continuation of application No. 14/448,498, filed on Jul. 31, 2014.

(51) Int. Cl.

| | |
|---|---|
| ***F21L 4/00*** | (2006.01) |
| ***F21V 15/01*** | (2006.01) |
| ***F21V 23/06*** | (2006.01) |
| *F21Y 101/02* | (2006.01) |

(52) U.S. Cl.

CPC . *F21L 4/005* (2013.01); *F21L 4/00* (2013.01); *F21V 15/01* (2013.01); *F21V 23/06* (2013.01); *F21L 7/00* (2013.01); *F21Y 2101/02* (2013.01)

(58) Field of Classification Search

CPC ..... F21L 15/00; F21L 15/06; F21L 15/08; F21L 15/0045; F21L 15/005

USPC ..... 362/171, 194–199, 202, 203–206, 208, 362/578, 579; 320/110

See application file for complete search history.

(56) References Cited

U.S. PATENT DOCUMENTS

| | | | | |
|---|---|---|---|---|
| 2,643,327 | A * | 6/1953 | Macklenar | F21L 15/06 174/138 R |
| 5,486,432 | A | 1/1996 | Sharrah et al. | |
| 5,633,574 | A | 5/1997 | Sage | |
| 5,904,414 | A * | 5/1999 | Monteleone | F21L 4/005 362/202 |
| 6,046,572 | A | 4/2000 | Matthews et al. | |
| 6,851,828 | B1 | 2/2005 | Hansen | |
| 6,942,359 | B2 | 9/2005 | Furth et al. | |
| 7,435,508 | B2 | 10/2008 | Lee et al. | |
| 7,891,833 | B2 | 2/2011 | Sharrah et al. | |
| 7,909,478 | B2 | 3/2011 | Dallas | |
| 8,356,910 | B2 | 1/2013 | Messinger et al. | |
| 8,382,312 | B2 * | 2/2013 | Crawford | B29C 70/32 362/202 |
| 8,727,561 | B2 | 5/2014 | Sharrah et al. | |
| 8,779,683 | B2 | 7/2014 | Snyder et al. | |
| 8,827,484 | B2 | 9/2014 | Messinger et al. | |

(Continued)

*Primary Examiner* — Evan Dzierzynski
*Assistant Examiner* — Zheng Song
(74) *Attorney, Agent, or Firm* — Clement A. Berard, Esq.; Dann, Dorfman, Herrell & Skillman, PC

(57) ABSTRACT

A sleeve for a portable light may comprise: a hollow sleeve for surrounding a source of electrical power and having a plurality of elongated longitudinal spring members. Only one end of each spring member is connected to a wall of the hollow sleeve and an opposite end thereof is free. Each spring member is formed to partly extend radially outward of the hollow sleeve and to partly extend radially inward of the hollow sleeve toward a source of electrical power that may be disposed therein. The hollow sleeve may be disposed in a portable light that may include a housing, a light source and a source of electrical power that may reside in the sleeve.

24 Claims, 23 Drawing Sheets

(56) References Cited

U.S. PATENT DOCUMENTS

| | | | | |
|---|---|---|---|---|
| 8,968,900 | B2 * | 3/2015 | Mullet | 429/100 |
| 2003/0077937 | A1 | 4/2003 | Berg et al. | |
| 2005/0122715 | A1 * | 6/2005 | Furth | F21L 4/005 362/208 |
| 2007/0279902 | A1 | 12/2007 | Kim | |
| 2010/0177507 | A1 | 7/2010 | West et al. | |
| 2010/0219775 | A1 | 9/2010 | Maglica et al. | |
| 2010/0301779 | A1 | 12/2010 | Spartano et al. | |
| 2013/0182419 | A1 | 7/2013 | Worman | |

* cited by examiner

FIGURE 1:
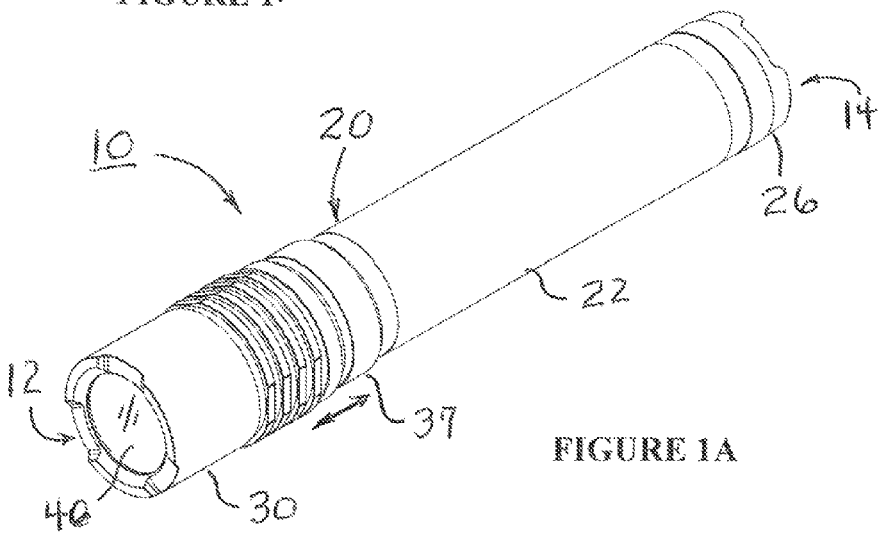
FIGURE 1A
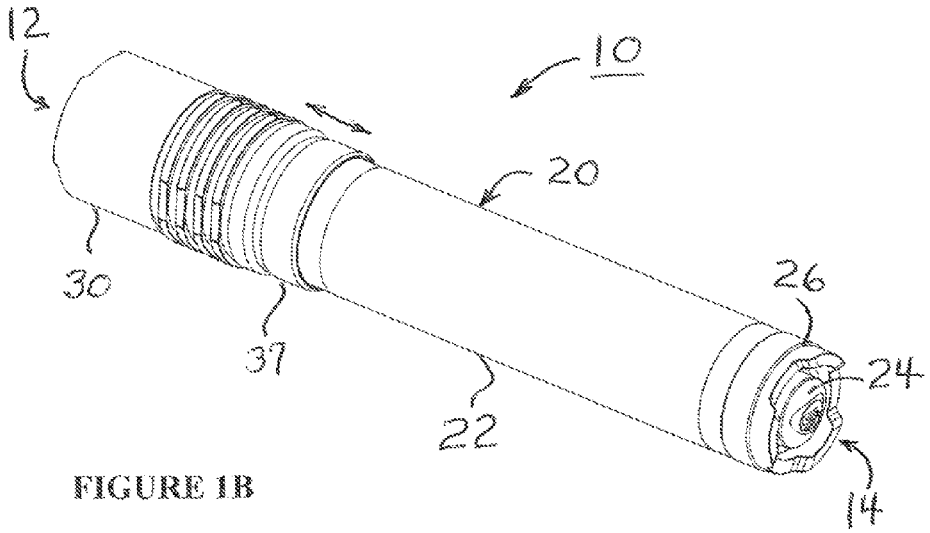
FIGURE 1B

FIGURE 2:
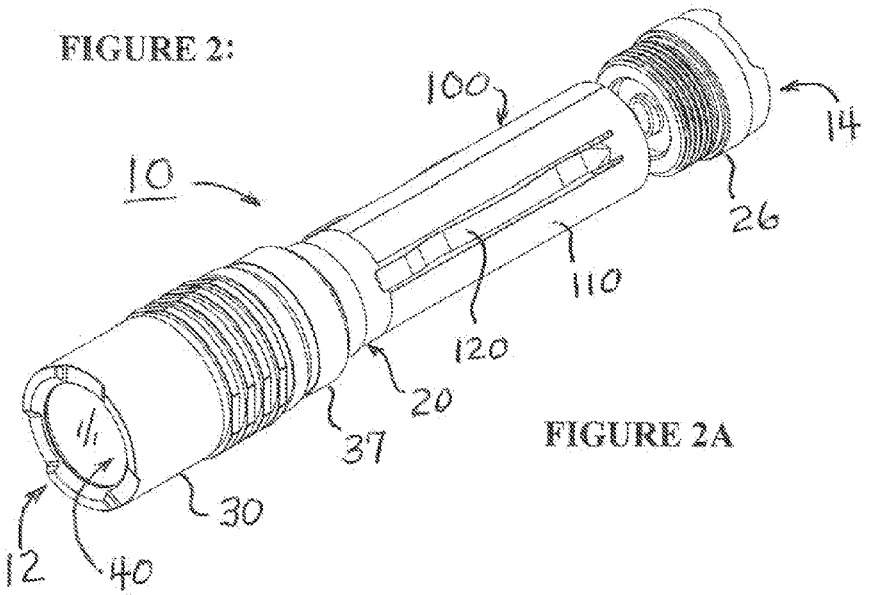
FIGURE 2A
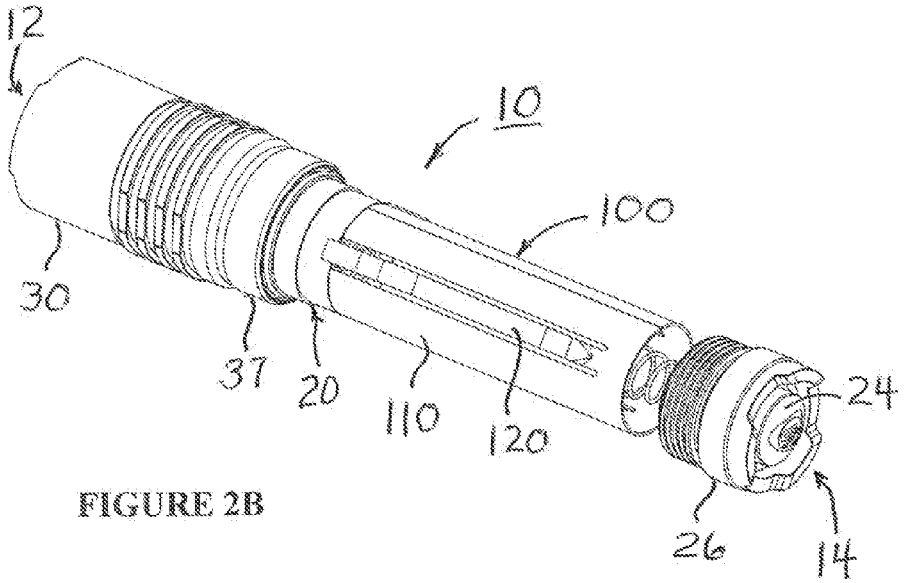
FIGURE 2B

PORTABLE LIGHT HAVING A SLEEVE INTERNAL THERETO AND SLEEVE THEREFOR

This Application is a continuation of U.S. patent application Ser. No. 14/448,498 entitled "PORTABLE LIGHT HAVING A SLEEVE INTERNAL THERETO AND SLEEVE THEREFOR" and filed Jul. 31, 2014, which is hereby incorporated herein by reference in its entirety.

The present invention relates to a portable light and, in particular, to a portable light having a sleeve therein and to a sleeve for a portable light.

Portable lights rely upon portable sources of electrical power to operate the light source or sources to produce light. The most common source of electrical power by far is the electro-chemical battery which is commonly and usually widely available in many different battery chemistries and in many different sizes and shapes. Lights that can utilize only one type of power source, e.g., one type of battery, may be less desirable than are lights that can utilize batteries of different sizes, shapes and battery chemistries.

Portable lights for utilizing different types of power sources generally employ one or more of at least two different techniques for accommodating different batteries. These generally fall into two different types—one to physically accommodate batteries of different physical sizes and shapes, and a second to accommodate batteries of different terminal voltages and capacities. The first generally involves physical accommodation while the second generally involves electronic accommodation.

Regarding physical accommodation, while specific accommodations for specific battery types have been proposed, these tend to be inflexible and may have difficulty keeping the batteries centered in the light housing where they can reliably make electrical contact with the terminals of other batteries and with terminals in the battery compartment of the light.

Applicant believes there may be a need for a way to allow a portable light not equipped to receive batteries of different physical sizes and shapes to do so.

Accordingly, a portable light including a sleeve may comprise: a housing, a light source, a source of electrical power, and a hollow sleeve for surrounding a source of electrical power and having a plurality of elongated longitudinal spring members. Only one end of each spring member is connected to a wall of the hollow sleeve and an opposite end thereof is free. Each spring member is formed to partly extend radially outward of the hollow sleeve and to partly extend radially inward into the hollow sleeve toward a source of electrical power that may be therein.

A sleeve for a portable light may comprise: a hollow sleeve for surrounding a source of electrical power and having a plurality of elongated longitudinal spring members. Only one end of each spring member is connected to a wall of the hollow sleeve and an opposite end thereof is free. Each spring member is formed to partly extend radially outward of the hollow sleeve and to partly extend radially inward into the hollow sleeve toward a source of electrical power that may be disposed therein.

An example sleeve for a portable light may comprise: a hollow sleeve of electrically conductive material disposable in a light housing to surround at least part of one or more sources of electrical power, having a wall and at least three elongated longitudinal spring members extending axially therefrom. Only one end of each of the spring members is connected to the wall of the hollow sleeve, and each has a length that is at least one half of the length of the one or more sources of electrical power. Each elongated longitudinal spring member is formed in a serpentine shape to partly extend in a radial direction outward of the hollow sleeve and to partly extend in a radial direction inward of the hollow sleeve. The dimension in a radial direction between the part formed to extend outward and the part formed to extend inward may be as large as the difference between an interior dimension of the light housing and an external dimension of the one or more sources of electrical power.

In summarizing the arrangements described and/or claimed herein, a selection of concepts and/or elements and/or steps that are described in the detailed description herein may be made or simplified. Any summary is not intended to identify key features, elements and/or steps, or essential features, elements and/or steps, relating to the claimed subject matter, and so are not intended to be limiting and should not be construed to be limiting of or defining of the scope and breadth of the claimed subject matter.

BRIEF DESCRIPTION OF THE DRAWING

The detailed description of the preferred embodiment(s) will be more easily and better understood when read in conjunction with the FIGS. of the Drawing which include:

FIG. 1 includes FIGS. 1A and 1B which are front and rear perspective views, respectively, of an example embodiment of a light including an example embodiment of a sleeve for a portable light;

FIG. 2 includes FIGS. 2A and 2B which are front and rear perspective views, respectively, of the example embodiment of a light of FIG. 1 with a portion of the housing removed to reveal an example embodiment of a sleeve for a portable light;

Figures 3, 3A:
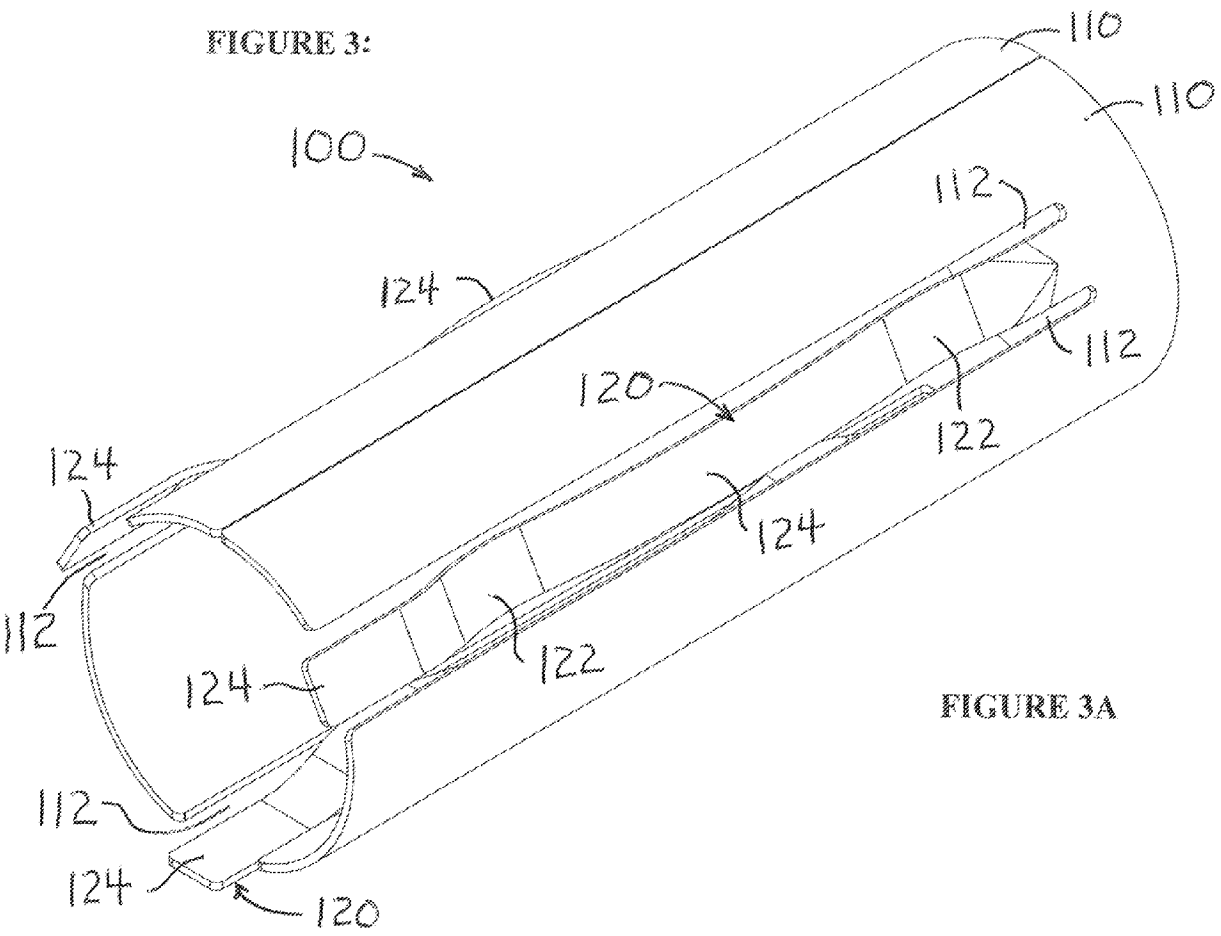
FIG. 3 includes FIGS. 3A and 3B which are a perspective view and a plan view, respectively, of an example embodiment of a sleeve for a portable light.

Where an element or feature is shown in more than one drawing figure, the same alphanumeric designation may be used to designate such element or feature in each figure, and where a closely related or modified element is shown in a figure, the same alphanumerical designation primed or the like may be used to designate the modified element or feature. Similarly, similar elements or features may be designated by like alphanumeric designations in different figures of the Drawing and with similar nomenclature in the specification. According to common practice, the various features of the drawing are not to scale, and the dimensions of the various features may be arbitrarily expanded or reduced for clarity, and any value stated in any Figure is given by way of example only.

DESCRIPTION OF THE PREFERRED EMBODIMENT(S)

FIG. 1 includes FIGS. 1A and 1B which are front and rear perspective views, respectively, of an example embodiment of a light 10 including an example embodiment of a sleeve for a portable light 10; and FIG. 2 includes FIGS. 2A and 2B which are front and rear perspective views, respectively, of the example embodiment of a light 10 of FIG. 1 with a portion 22 of the housing 20 removed to reveal an example embodiment of a sleeve 100 for a portable light. Portable light 10 includes a light housing 20 having a barrel 22 for receiving one or more sources of electrical power 50, e.g., one or more batteries 52, therein and may have a head 30 at a head or forward end 12 thereof and have a tail or rearward end 14 opposite the head end 12. Head 30 may have therein or may support a light source 40. A switch 24 may be provided at tail end 14 or at any convenient location on light housing 20; as illustrated, switch 24 is part of tail cap 26 that threadingly engages with threads of the rearward end of barrel 22 and is actuated by axial pressure through a flexible boot or cover.

Within barrel 22 of light housing 20 is disposed a hollow sleeve 100 having a thin wall of similar shape to an interior cavity of barrel 22. Hollow sleeve 100 preferably has a transverse dimension, e.g., a diameter, that is slightly less than the transverse dimension, e.g., an inner diameter, of barrel 22, so as to be slidable therein, e.g., when tail cap 26 is removed. Within the interior space of hollow sleeve 100 is disposed an electrical power source 50, e.g., a battery pack 50 or batteries 52.

Hollow sleeve 100 has a plurality of elongated longitudinal springs 120 that extend axially over a substantial portion of the longitudinal length of sleeve 100. Springs 120 are formed in a radial direction so as to bear against the interior surface of the wall of barrel 22 and against the exterior surface of electrical power source 50, 52 when it is disposed in hollow sleeve 100. In the illustrated embodiment, elongated longitudinal springs 120 extend beyond the end or hollow sleeve 100, e.g., beyond the forward end thereof when disposed in barrel 22, so as to contact housing 20 at the forward end of hollow sleeve 100, e.g., for making electrical connection thereat. Where hollow sleeve is employed to provide an electrical conductor between the forward end of barrel 22 and the rearward end thereof, e.g., at tail cap 26, sleeve 100 is made of an electrically conductive material, e.g., a metal.

Typically, portable light 10 includes a light source 40 including one or more light emitting diodes (LEDs) at or near the forward end 12 thereof that are connected in an electrical circuit of light 10 including an internal source of electrical power 50, e.g., one or more batteries, and a switch 24 for selectively energizing light source 40 to produce light.

Light housing 20 illustrated has a head 30 that includes a collar 37 thereon which extends rearwardly to barrel 22. Collar 37 may be slidable longitudinally rearward on housing 20 (towards end 14) of portable light 10 to expose a charging connection where light 10 includes a rechargeable electrical power source, and slidable longitudinally forward on housing 20 to cover such charging connection, as indicated by a double-ended arrow.

Head 30 in a preferred embodiment has one or more outwardly (radially) extending circumferential flanges or rings thereon, e.g., four circumferential rings on collar 37, and each ring may have one or more flat portions so as to reduce the tendency of light 10 to roll. The illustrated example has four rings with three flat portions about 120° apart around the circumference thereof.

Figure 3B:
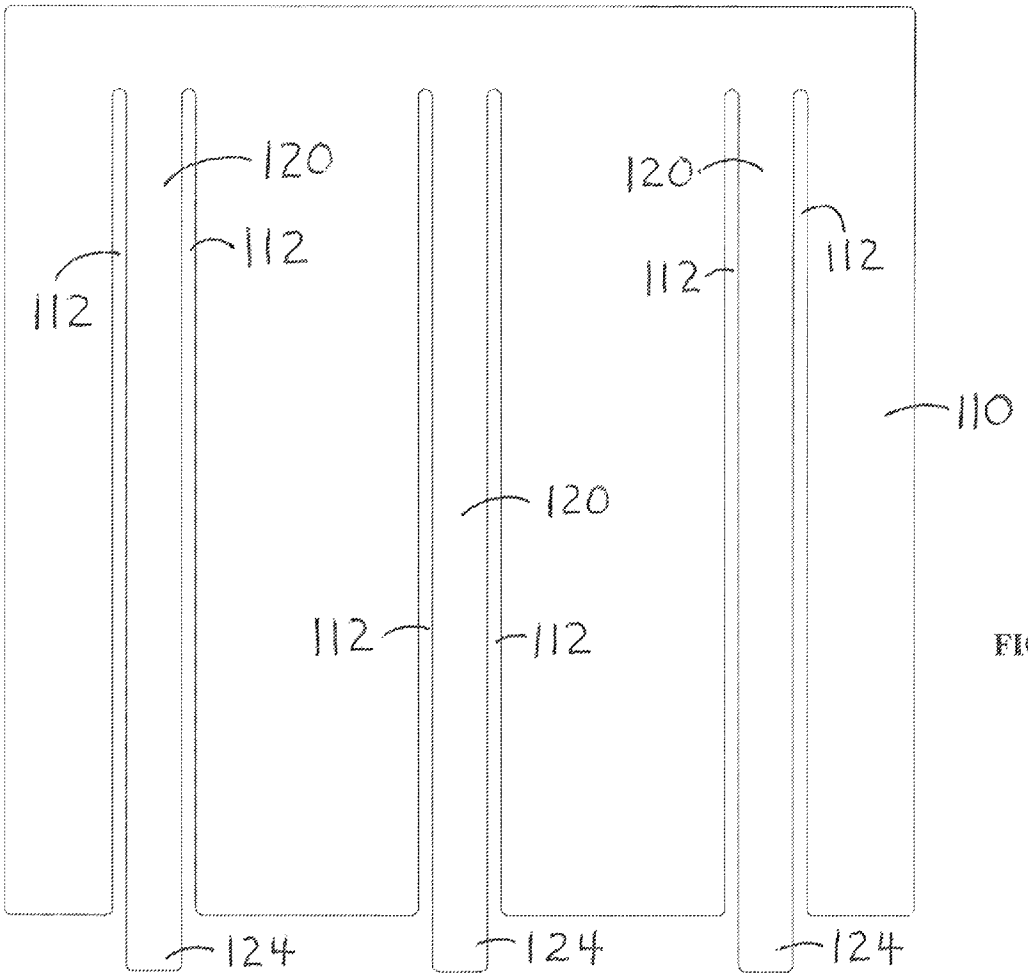

FIG. 3 includes FIGS. 3A and 3B which are a perspective view and a plan view, respectively, of an example embodiment of a sleeve 100 for a portable light, FIG. 3B illustrating sleeve 100 when not formed into a sleeve 100. Example hollow sleeve 100 has a relatively thin formed wall 110 that has a plurality of pairs of elongated longitudinal slots 112 therethrough that define a plurality of elongated longitudinal spring members 120.

In a preferred embodiment, hollow sleeve 100 is formed from a substantially rectangular blank 110 that maybe, e.g., stamped or otherwise cut out from a sheet of blank material, with the serpentine shape being formed in the elongated longitudinal spring members 120, e.g., in the aforementioned forming, e.g., stamping, or in another, e.g., subsequent, suitable forming step. Each pair of slots 112 defines one of the plural elongated spring members 120 and each one thereof defines a single spring member 120 that preferably extends longitudinally beyond the edge of wall 110 and is at least more than half of the longitudinal length of hollow sleeve 100, and more preferably extends more than three-quarters (75%) of the longitudinal length of hollow sleeve 100. In the illustrated example embodiment, slots 112 may extend approximately eighty-five to ninety percent (≈85-90%) of the longitudinal length of hollow sleeve 100 and longitudinal serpentine spring members 120 may extend approximately eighty-seven to ninety-three percent (≈87-93%) of the longitudinal (axial) length of hollow sleeve 100.

The serpentine shape of elongated longitudinal spring members 120 is formed radially to partly extend in a radial direction outward of hollow sleeve 120 and to partly extend in a radial direction inward into hollow sleeve 120, thereby to be formed to bear against the interior surface of barrel 22 and against the exterior surface of electrical power source 50, respectively. In a preferred embodiment, the serpentine shape of elongated longitudinal spring members 120 is formed to have two parts 122 that extend in a radial direction inward into hollow sleeve 120 and to have at least one part 124 therebetween that extends in a radial direction outward of hollow sleeve 120. A second part 124 therebetween that extends in a radial direction outward of hollow sleeve 120 may be provided at the end of spring member 120 remote from its connection to wall 110, e.g., the free end thereof.

In general, where electrical power source 50, 52 includes plural separate power sources 50, e.g., plural separate batteries 52, spring member 120 may be and preferably is formed to have a number of inward extending parts 122, e.g., a number that preferably corresponds to the number of separate electrical power sources 50, 52. Spring members 120 may also be so formed where power source 50 has substantial length. Thus, elongated springs 120 tend to center power source 50, 52 within sleeve 100 in barrel 22 of housing 20.

The dimension in a radial direction between the part of elongated longitudinal serpentine spring member 120 formed to extend outward and the part of elongated longitudinal serpentine spring member 120 formed to extend inward is preferably at least as large as one half the difference between the interior dimension of the barrel 22 of light housing 20 and the external dimension of the one or more sources of electrical power 50 having a smaller transverse exterior dimension. It is noted that the cross-sectional shape of sleeve 100 may be circular as illustrated, e.g., to contain substantially cylindrical power sources 50, 52 of like cross-sectional shape, but may also be of other cross-sectional shapes, e.g., where electrical power sources 50, 52 of different shapes and/or configurations are to be employed.

If only one elongated longitudinal serpentine spring member 120 was to be provided, then power source(s) 50 would tend to be urged sideways and be moved off center to rest against the wall 110. It is preferred that plural elongated longitudinal serpentine spring members 120 be employed, e.g., preferably at least three or more elongated longitudinal serpentine spring members 120, and that they be substantially evenly spaced apart around the circumference of hollow sleeve 100, so as to tend to urge and retain power source(s) 50 to be substantially centered within hollow sleeve 100 and barrel 22 of housing 20. For example, where three elongated longitudinal serpentine spring members 120 are provided, they preferably are spaced apart angularly by about 120°; and where four elongated longitudinal serpentine spring members 120 are provided, they are preferably spaced apart angularly by about 90°.

The edges of wall 110 that are adjacent each other when hollow sleeve 100 is formed into a tubular shape may be, but need not be, attached to each other, e.g., by one or more welds, solder, brazing, heat or sonic welding, adhesive, tape adhesive, or by another suitable attachment.

Figures 4, 4A:
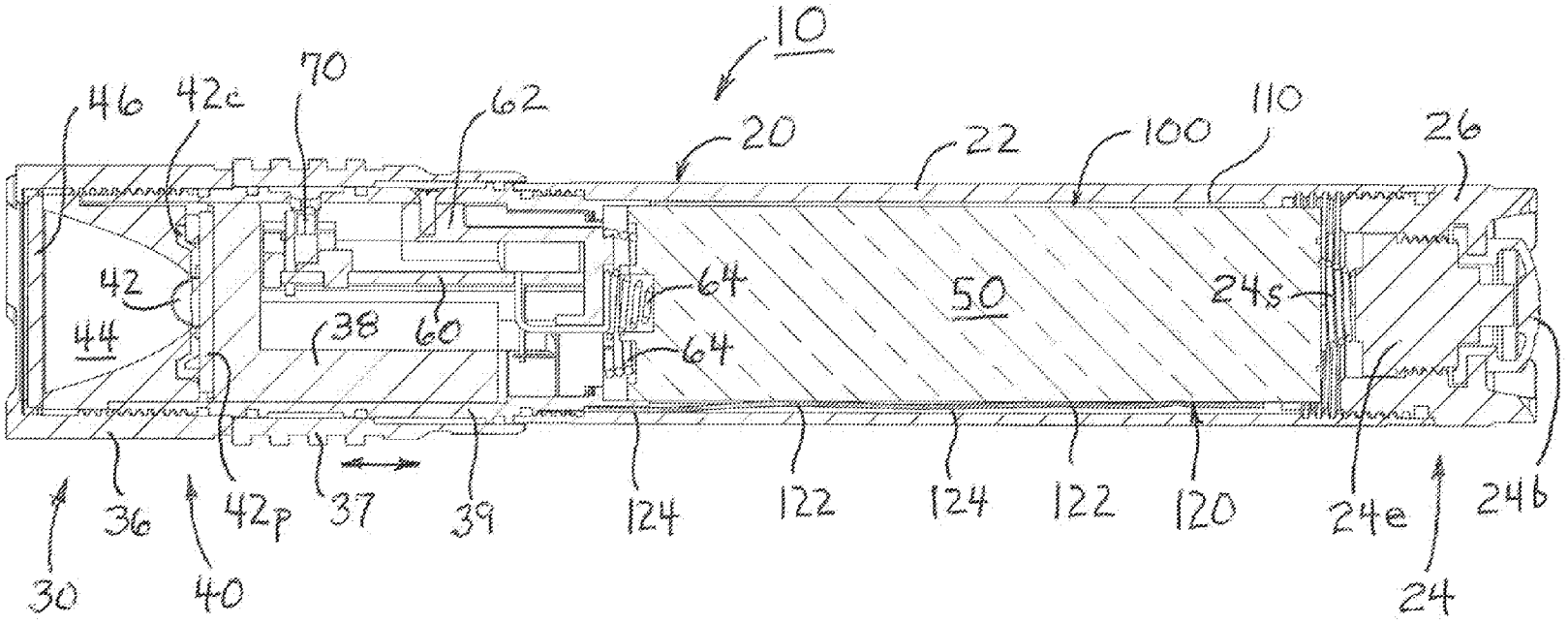
FIG. 4 includes FIGS. 4A and 4B which are longitudinal and transverse cross-sectional views, respectively, of the example portable light having the example sleeve therein with a power source of larger diameter therein.
Figure 4B:
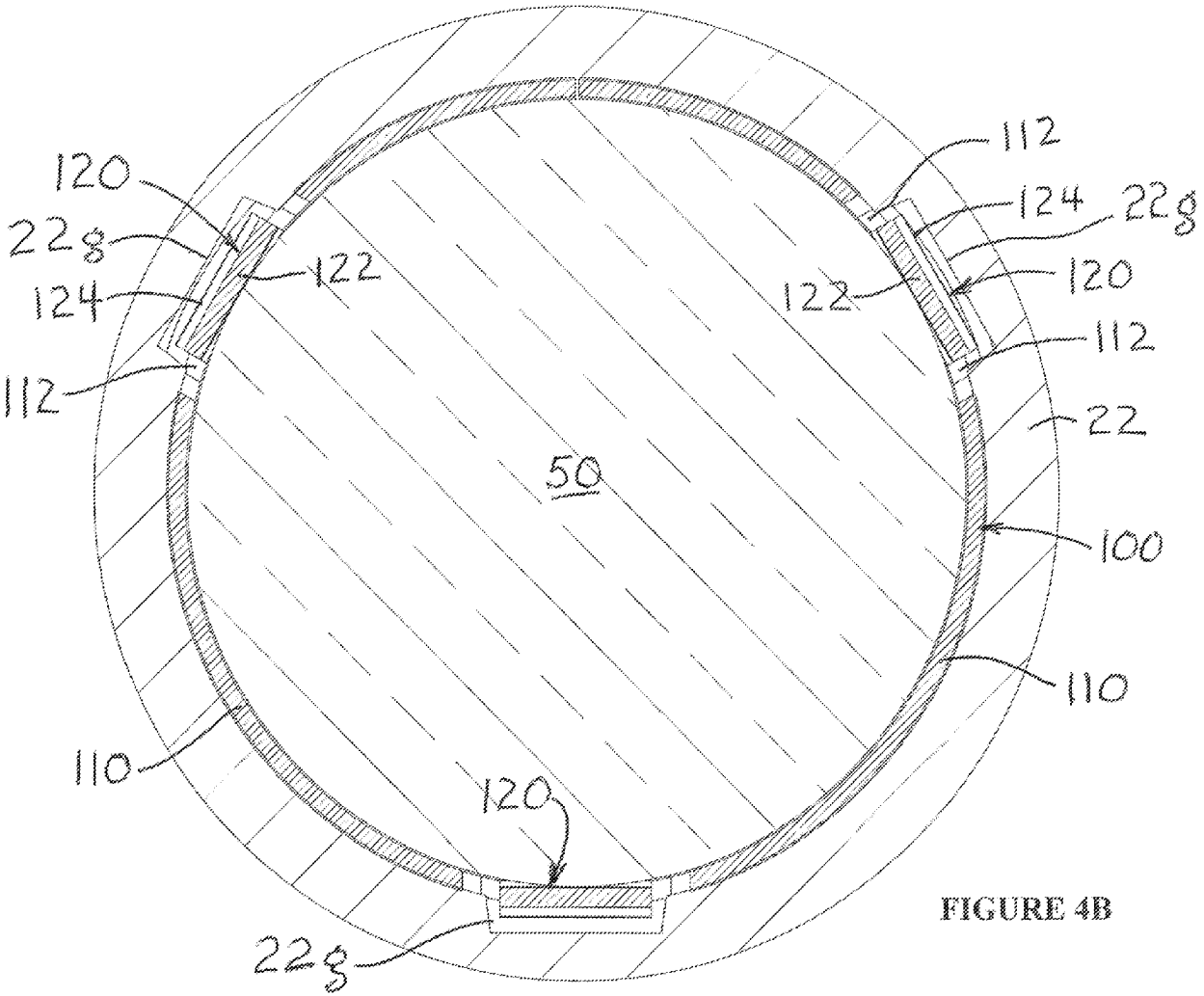
Figures 5, 5A:
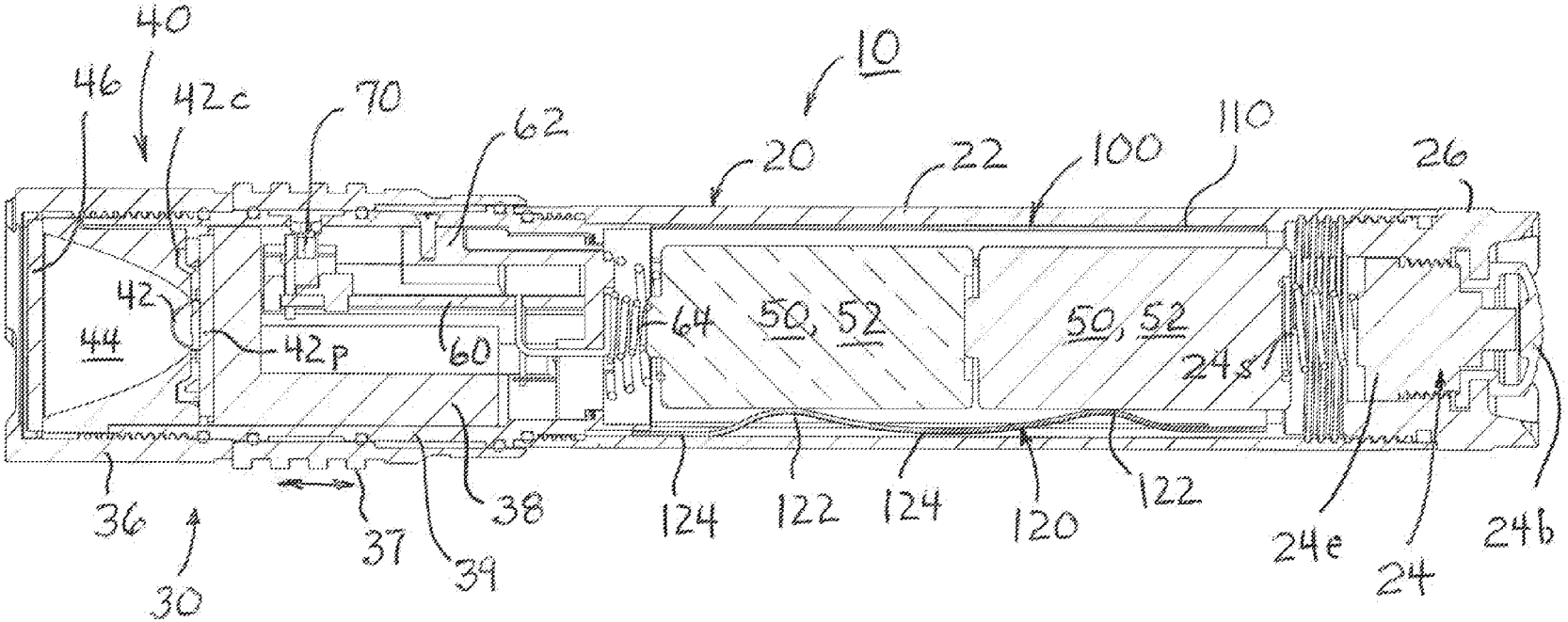
FIG. 5 includes FIGS. 5A and 5B which are longitudinal and transverse cross-sectional views, respectively, of the example portable light having the example sleeve therein with a power source of smaller diameter therein.
Figure 5B:
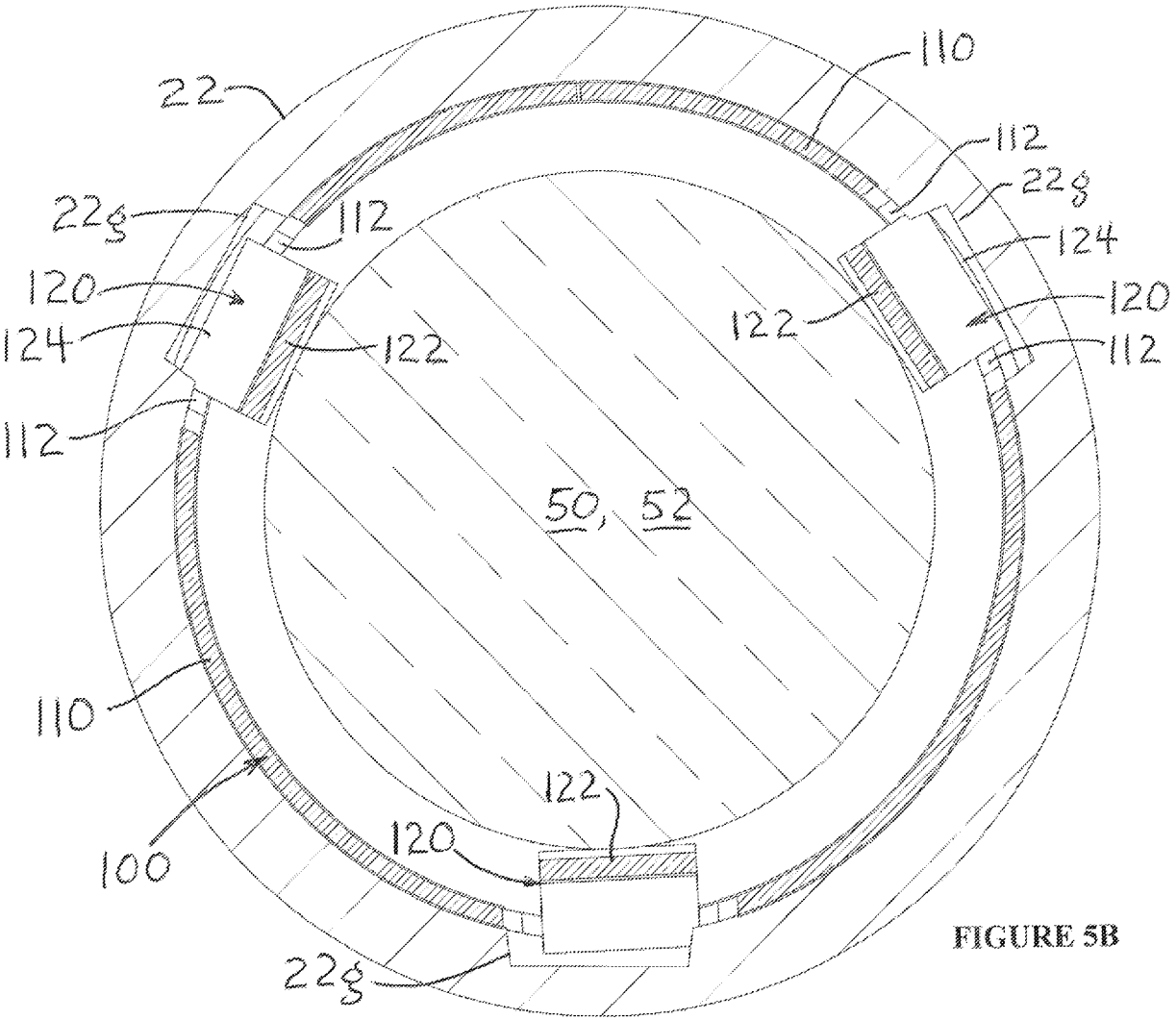

FIG. 4 includes FIGS. 4A and 4B which are longitudinal and transverse cross-sectional views, respectively, of the example portable light 10 having the example sleeve 100 therein with a power source 50, 52 of larger diameter therein; and FIG. 5 includes FIGS. 5A and 5B which are longitudinal and transverse cross-sectional views, respectively, of the example portable light 10 having the example sleeve 100 therein with a power source 50, 52 of smaller diameter therein.

Typically, light source 40 may include at least one light emitting diode (LED) 42 disposed at the narrow or base end of a reflector 44, all of which may be covered at the wide end of reflector 44 by a transparent lens 46 which is retained on head 30 by a lens ring 36. LED 42 may be mounted on an electrical circuit board 42*p* and may have an LED cover 42*c* for, e.g., protection, heat spreading, positioning or another purpose. Circuit board 42*p* is configured to be thermally mounted to heat sink 38 for removing heat generated by LED 42 to heat sink 38 and positioning LED 42 in a predetermined position relative to reflector 44.

An electrical circuit of portable light 10 electrically connects electrical power source 50, light source 40, and switch 24 for selectively energizing LED 42 to produce light which is projected through lens 46 and away from light 10. The electrical circuit may be a simple circuit, e.g., of interconnecting electrical conductors and one or more resistors, or may be, e.g., a more sophisticated circuit including a controller, e.g., a microprocessor, one or more DC converters, one or more LEDs, and the like, as is known in the art. Circuit board 60 typically contains a substantial part of the electrical circuit and is supported in housing 20 by circuit board holder 62. Hollow sleeve 100 may be made of an electrically conductive material and in certain embodiments may provide an electrical conductor for the electrical circuit.

One or more springs 64 may extend rearwardly from circuit board 60 and its holder 62 for making electrical connection to one or more electrical contacts disposed on the forward end of electrical power source 50, 52. Switch 24 may have one or more springs 24*s* extending forwardly for making electrical connection to the rearward end of electrical power source 50, 52, and tail cap 26 may be electrical connection to hollow sleeve 100 and/or to barrel 22, e.g., where hollow sleeve 100 and/or barrel 22 serve as an electrical conductor.

Moreover, portable light 10 may employ sources of electrical power 50 that are for a single use, e.g., alkaline or lithium-ion batteries, or may employ sources of electrical power that are rechargeable, e.g., rechargeable lithium or NiMH batteries. To this end, portable light 10 may include one or more external electrical connections for connecting to a charging source, e.g., a USB port 70. Specifically, e.g., circuit board 60 may include a connection 70, e.g., a USB port 70, extending radially into an opening in housing coupling member 39 for receiving charging current to recharge the power source 50, 52. Axially slidable collar 37 may be provided to slide to positions to cover and to expose charging port 70.

Housing coupling 39 attaches to barrel 22 at its rearward end and slidably carries a slidable cover 37 that can be moved longitudinally along housing 20 to expose and cover charging connection 70, e.g., USB port 70. An annular gap between an outer surface at the rearward end of coupling 39 and an inner surface at the forward end of barrel 22 provide a space or gap in which the free ends 124 of longitudinal springs 120 of hollow sleeve may move longitudinally (axially) when an electrical power source 50, 52 is inserted into and/or is removed from hollow sleeve 100. Lens ring 36 threadingly engages the forward end of housing coupling 39 and retains lens 46 therebetween. Housing coupling 39 preferably has one or more O-rings there around for providing seals between housing coupling 39 and lens ring 36 and slidable cover 37.

Example portable light 10 may include, e.g., between the rearward end of light source 40 and the forward end of electrical power source 50, an electronic circuit 60 of the latter more sophisticated type and electrical connections via a USB port 70 for recharging a rechargeable battery 50 in the barrel 22 of light housing 20.

In FIGS. 4A and 4B, serpentine elongated longitudinal spring members 120 bear against the interior of barrel 22 and the exterior of larger diameter electrical power source 50, e.g., a battery pack 50, and deform substantially due to the small difference between the diameters thereof. In FIGS. 5A and 5B, serpentine elongated longitudinal spring members 120 bear against the interior of barrel 22 and the exterior of smaller diameter electrical power source 50, e.g., batteries 52, and deform to a lesser extent due to the large difference between the diameters thereof.

In both instances, as an electrical power source 50, 52 is inserted into hollow sleeve 100, longitudinal springs 120 thereof are deformed from their relaxed serpentine shape to a shallower serpentine shape and, because the rearward ends of longitudinal springs 120 are attached to wall 110 of hollow sleeve 100 and are not free to move, the forward or free ends 124 of longitudinal springs 120 move forwardly into the annular space between barrel 22 and hollow sleeve 100 to a greater or lesser extent depending upon the difference between the exterior and interior transverse dimensions, e.g., exterior and interior diameters, of the electrical power source 50, 52 and of barrel 22 of housing 20, respectively.

Thus, the plurality of individual longitudinal serpentine spring members 120 facilitate hollow sleeve 100 not only accommodating, positioning and centering batteries from different manufacturers having different diameters due to differences in design and/or manufacturing, but also accommodating, positioning and centering batteries of different types having different diameters by design. For example, hollow sleeve 100 may be sized to accommodate the larger diameter of a battery pack 50 containing lithium batteries, and to accommodate individual smaller diameter type CR123 batteries (e.g., a lithium cell batteries), or other battery packs and batteries of different shapes, sizes and types. By way of further example, hollow sleeve 100 may be sized to accommodate larger diameter size AA batteries and smaller diameter size AAA batteries, or it may be sized to accommodate larger diameter type CR123 batteries (e.g., a lithium cell battery) and smaller diameter size AA batteries (e.g., lithium cell or alkaline cell batteries), or other batteries of different shapes, sizes and types.

Because the plural longitudinal serpentine spring members 120 extend over a substantial part of the length of hollow sleeve 100 and of power source 50 (e.g., batteries 52) and because each connects to wall 110 of hollow sleeve 100 only at one end thereof, the free end 124 of each longitudinal serpentine spring member 120 is free to move longitudinally (e.g., to extend axially) as the radial distance between the inward and outward peaks of longitudinal serpentine spring member 120 is reduced (compressed) while bearing against the sides of the power source 50 (e.g., batteries 52) and housing 20.

Thus, serpentine elongated longitudinal spring members 120 are seen to accommodate a relatively wide range of different diameter power sources 50, e.g., different diameter batteries 52, because they are elongated in the longitudinal direction and are connected to wall 110 of hollow sleeve 100 only at one end thereof, thereby to not be restrained longitudinally and to have relative freedom to deform both radially and longitudinally (axially) to accommodate different power sources 50, 52 of substantially different diameters.

Preferably the serpentine shape of elongated longitudinal spring members 110 is a relatively "gentle" or curved shape as illustrated, rather than a "sharp" shape, so as to more broadly contact the sides of power source(s) 50 (e.g., batteries 52), thereby to tend to urge power source(s) 50 (e.g., batteries 52) into a relatively straight line alignment near the center axis of barrel 22. Moreover, it may also be preferred that the parts 122 of longitudinal spring members 110 extending inward relatively correspond to the axial centers of power source(s) 50 (e.g., batteries 52), to the extent such can be accommodated given the differences in sizes and shapes of the different power source(s) 50 (e.g., batteries 52) to be accommodated in barrel 22.

Optionally, but preferably, housing 20, e.g., barrel 22, may have longitudinal grooves 22*g* that correspond in angular position and length with the angular position and extended length of longitudinal springs 120 of hollow sleeve 100. In the illustrated example embodiment, grooves 22*g* are about 120° apart angularly as are longitudinal springs 120. In addition, springs and/or contact springs 24*s*, 64 expand and compress to accommodate the different axial lengths of the different power sources 50 (e.g., battery packs 50 and/or individual batteries 52) of different types, sizes and shapes to be accommodated within hollow sleeve 100 in barrel 22.

Where electrical power source 50, 52, e.g., a battery pack 50, has a central forward electrical contact surrounded by a circular, e.g., annular, electrical contact, both central spring 64 and surrounding outer spring 64 each provide electrical connections to power source 50, 52, e.g., to battery pack 50. Where electrical power source 50, 52, e.g., individual batteries 52, have a central forward electrical contact and a central rearward electrical contact, central spring 64 and rearward spring 24*s* provide respective electrical connections to power source 50, 52, e.g., to individual batteries 52.

Figures 6, 6A:
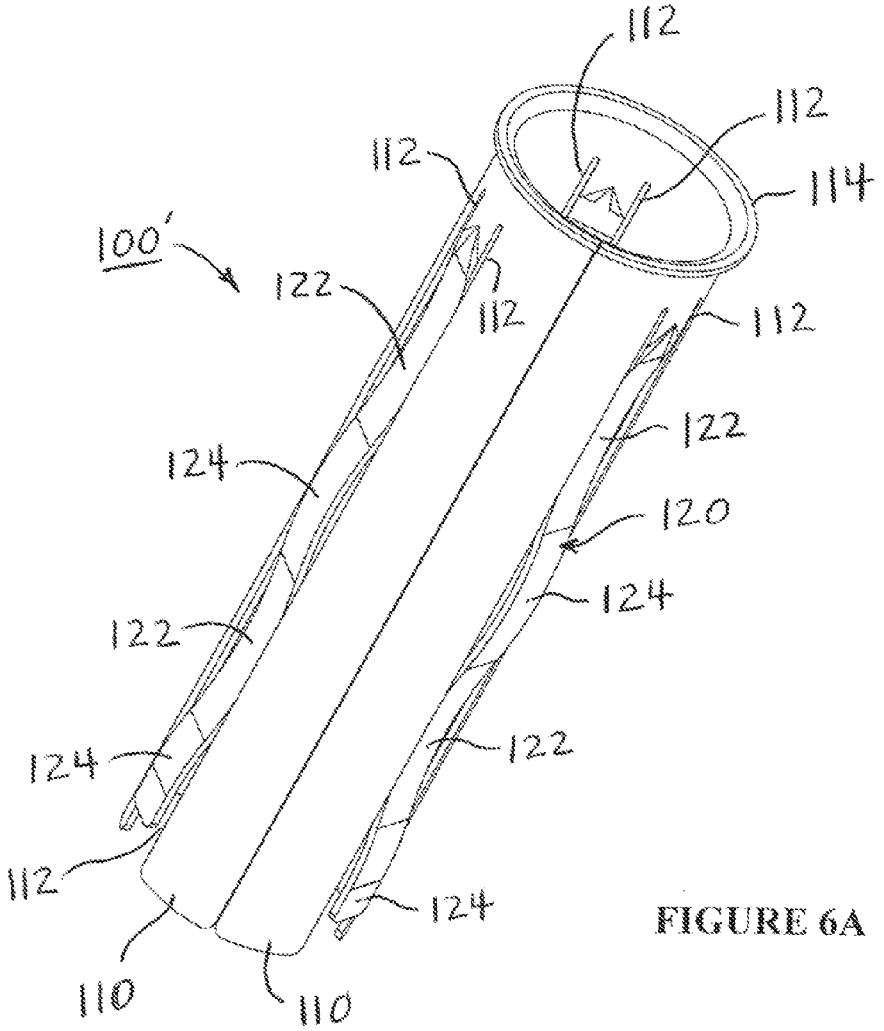
FIG. 6 includes FIGS. 6A and 6B which are a perspective view and a plan view, respectively, of an alternative example embodiment of a sleeve for a portable light.
Figure 6B:
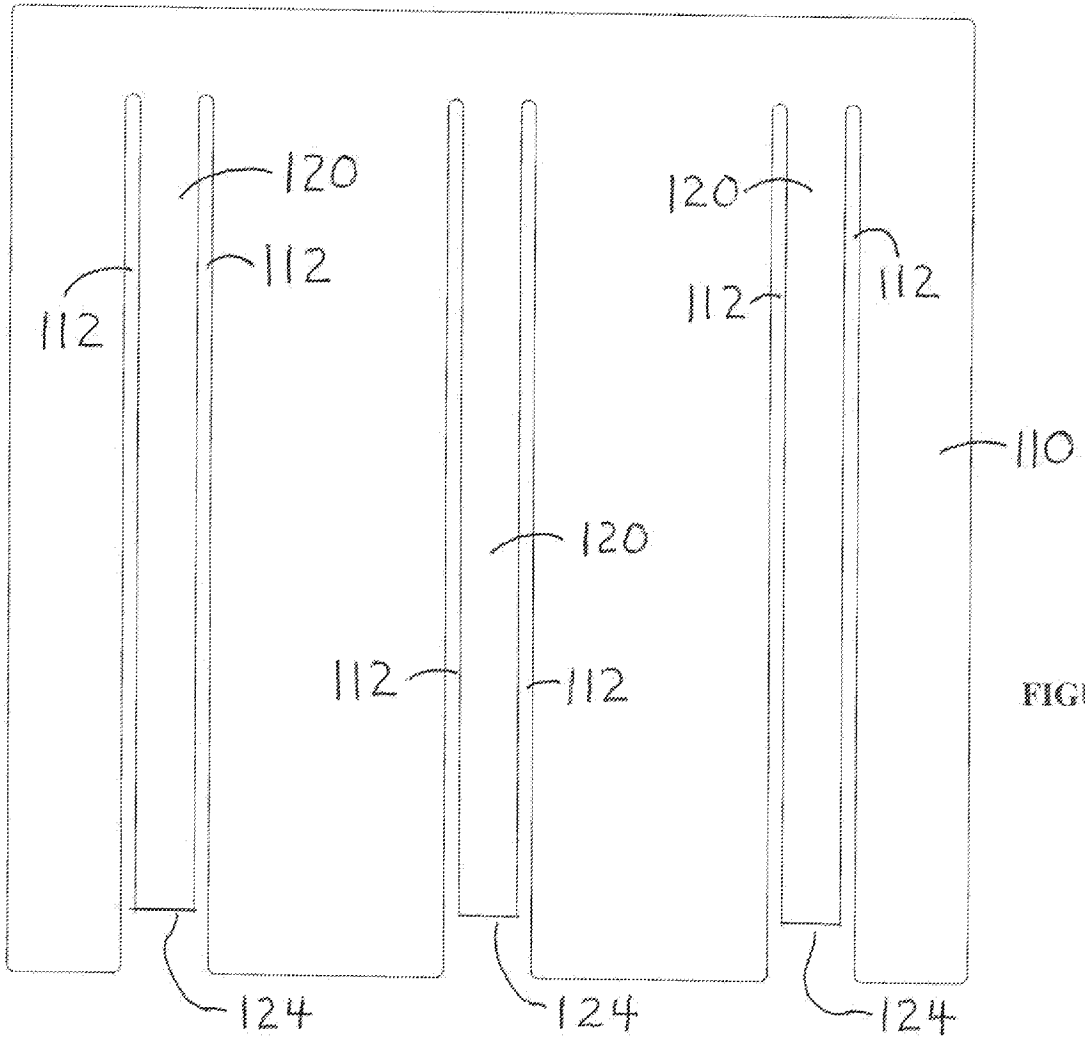

FIG. 6 includes FIGS. 6A and 6B which are a perspective view and a plan view, respectively, of an alternative example embodiment of a sleeve 100' for a portable light 10. Example hollow sleeve 100' has a relatively thin formed wall 110 that has a plurality of pairs of elongated longitudinal slots 112 therethrough that define a plurality of elongated longitudinal spring members 120 having only one end thereof joined with wall 110 and the other end thereof being free. Where the length of elongated longitudinal spring members 120 is less than the length of wall 110, each pair of slots 112 may join together at the free end of spring 120 and so may be described as elongated longitudinal U-shaped slots 112.

In a preferred embodiment, hollow sleeve 100' is formed from a substantially rectangular blank 110 that maybe, e.g., stamped or otherwise cut out from a sheet of blank material, with the serpentine shape being formed in the elongated longitudinal spring members 120, e.g., in the aforementioned forming, e.g., stamping, or in another, e.g., subsequent, suitable forming step. Each elongated spring member 120 is a single spring member that preferably extends at least more than half of the longitudinal length of hollow sleeve 100, and more preferably extends more than three-quarters (75%) of the longitudinal length of hollow sleeve 100. In the illustrated example embodiment, U-shaped slot 112 extends approximately ninety-four percent (≈94%) of the longitudinal length of hollow sleeve 100' and longitudinal serpentine spring member 120 extends axially approximately eighty-seven percent (≈87%) of the longitudinal length of hollow sleeve 100'.

The serpentine shape of elongated longitudinal spring members 120 is formed radially to partly extend in a radial direction outward of hollow sleeve 120 and to partly extend in a radial direction inward into hollow sleeve 120, thereby to be formed to bear against the interior surface of barrel 22 and against the exterior surface of electrical power source 50, respectively. In a preferred embodiment, the serpentine shape of elongated longitudinal spring members 120 is formed to have two parts 122 that extend in a radial direction inward into hollow sleeve 120 and to have at least one part 124 therebetween that extends in a radial direction outward of hollow sleeve 120. A second part 124 therebetween that extends in a radial direction outward of hollow sleeve 120 may be provided at the end of spring member 120 remote from its connection to wall 110. In general, where electrical power source 50, 52 includes plural separate power sources 50, e.g., plural separate batteries 52, spring member 120 may be formed to have a number of inward extending parts 122 corresponding to the number of separate electrical power sources 50, 52.

The dimension in a radial direction between the part of elongated longitudinal serpentine spring member 120 formed to extend outward and the part of elongated longitudinal serpentine spring member 120 formed to extend inward is preferably at least as large as the difference between the interior dimension of the barrel 22 of light housing 20 and the external dimension of the one or more sources of electrical power 50. It is noted that the cross-sectional shape of sleeve 100' may be circular as illustrated, e.g., to contain power sources 50, 52 of like cross-sectional shape, but may also be of other cross-sectional shapes where electrical power sources 50, 52 of different shapes and/or configurations are to be employed.

If only one or elongated longitudinal serpentine spring members 120 were to be provided, then power source(s) 50 would tend to be urged sideways and be moved off center to rest against the wall 110. Hollow sleeve 100 could have two pairs of longitudinal slots 112 defining two elongated longitudinal spring members 120 that are not substantially 180° apart around hollow sleeve 100' so as to urge electrical power source 50, 52 into a predetermined un-centered position whereat electrical connection thereto could be reliably made.

It is preferred that at least three or more elongated longitudinal serpentine spring members 120 be employed, and that they be evenly spaced apart around the circumference of hollow sleeve 100', so as to tend to move and retain power source(s) 50 substantially centered within hollow sleeve 100' and barrel 22 of housing 20. For example, where three elongated longitudinal serpentine spring members 120 are provided, they preferably are spaced apart angularly by about 120°; and where four elongated longitudinal serpentine spring members 120 are provided, they preferably are spaced apart angularly by about 90°.

Hollow sleeve 100' may also have a outwardly extending rim flange 114 formed around the rim at one end of wall 110, preferably the end closest to the end of U-shaped slot 112 whereat spring member 120 connects with wall 110. Rim flange 114 may serve to limit the insertion of hollow sleeve 100' into the barrel 22 of light housing 20. Rim flange 114 may be formed after the blank for hollow sleeve is formed into a tubular shape, e.g., a cylindrical shape, so as to tend to retain hollow sleeve 100' in that formed tubular shape. The edges of wall 110 that are adjacent each other when hollow sleeve 100' is formed into a tubular shape may be, but need not be, attached to each other, e.g., by one or more welds, solder, brazing, heat or sonic welding, adhesive, or by another suitable attachment.

Figures 7, 7A:
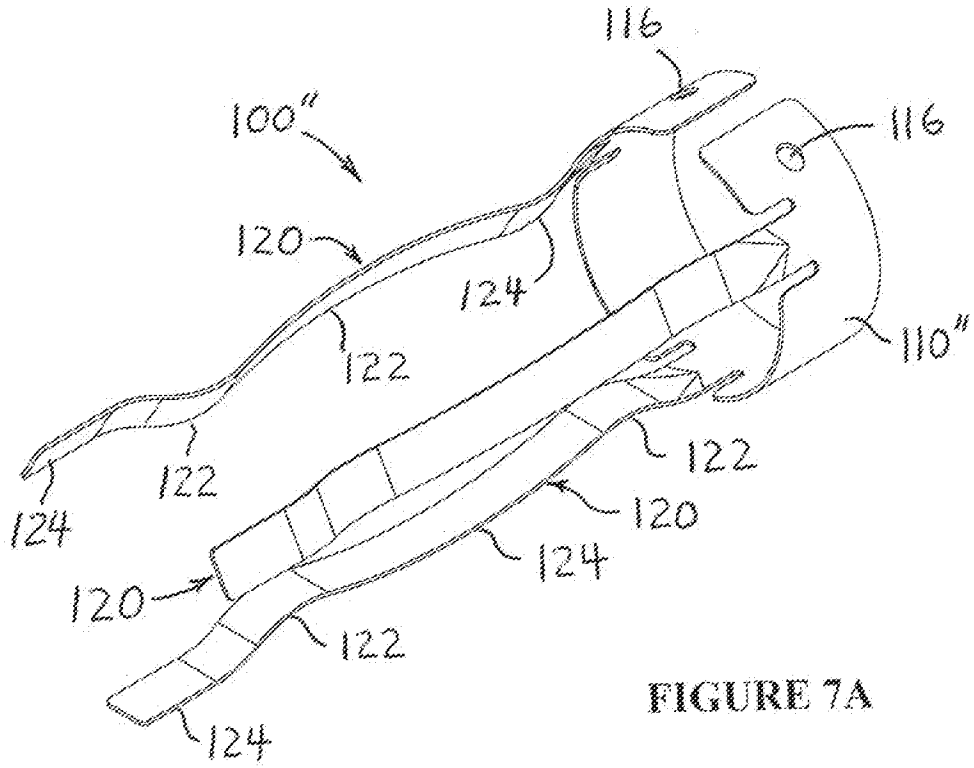
FIG. 7 includes FIGS. 7A and 7B which are a perspective view and a plan view, respectively, of another alternative example embodiment of a sleeve for a portable light.
Figure 7B:
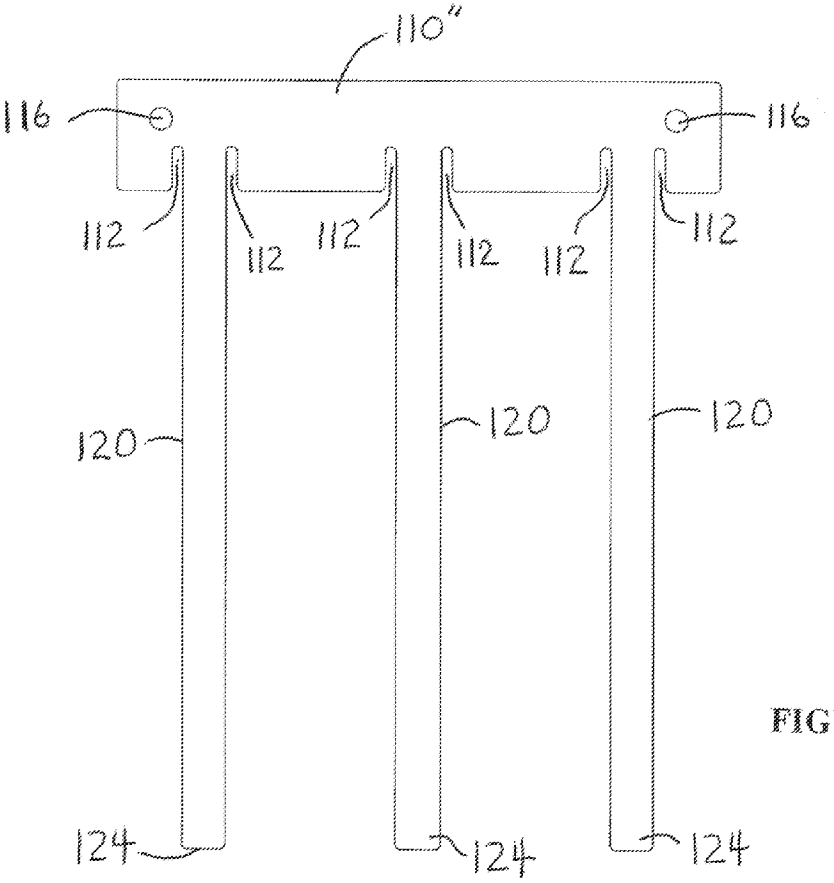
Figure 8:
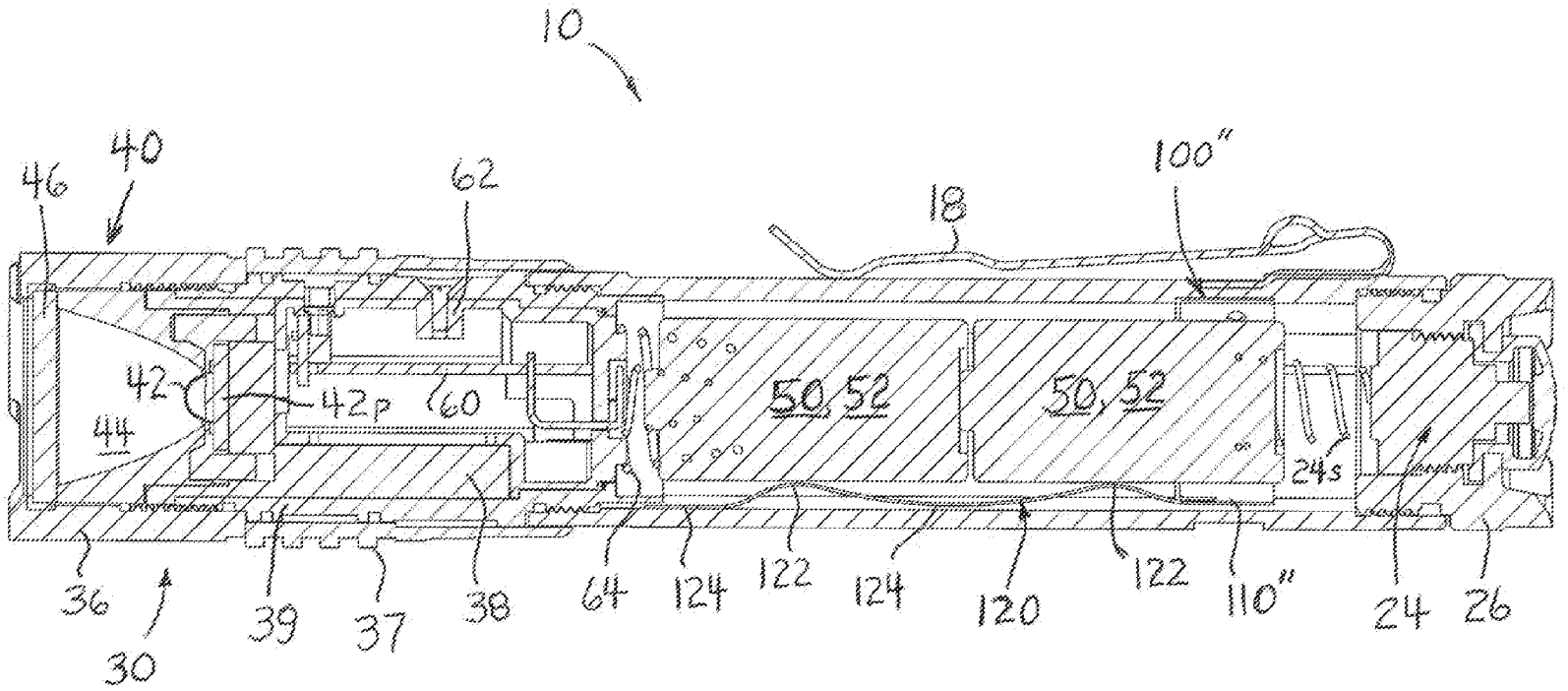
FIG. 8 is a longitudinal cross-sectional view of the example portable light having the example sleeve of FIG. 7 therein with a power source of smaller diameter therein.

FIG. 7 includes FIGS. 7A and 7B which are a perspective view and a plan view, respectively, of another alternative example embodiment of a sleeve 100" for a portable light 10; and FIG. 8 is a longitudinal cross-sectional view of the example portable light 10 having the example sleeve 100" of FIG. 7 therein with a power source 50, 52 of smaller diameter therein.

Sleeve 100" is similar in configuration to sleeves 100 and 100' except that the longitudinal or axial length of its cylindrical wall 110" and of the pairs of slots 112 therein is substantially shorter than the length of wall 110 of sleeves 100 and 100'. In function and operation, sleeve 100" is like sleeves 100 and 100' described above. As above, cylindrical wall 110" thereof need only be of sufficient axial length to support and position elongated spring members 120 longitudinally in barrel 22 in the space between the exterior surface of electrical power source 50, 52 and the interior surface of barrel 22 of housing 20 of portable light 10. Longitudinal elongated springs 120 are typically at least more than half of the longitudinal length of hollow sleeve 100" likewise to hollow sleeves 100 and 100' described above, and elongated springs 120 are defined at least in part by a pair of parallel slots 112 as described above.

Elongated longitudinal spring members 120 need only to be of sufficient length to perform their intended function in light 10 as described above. Where sleeve 100" is intended only to position electrical power source 50, 52 within barrel 22, elongated spring members 120 need only be of sufficient length to urge electrical power source 50, 52 toward a central position within barrel 22, and so may be longer than or shorter than or the same length as electrical power source 50, 52. The radially serpentine shape of elongated spring members 120 preferably has at least as many inward deflections 122 as there are electrical power sources 50, 52, e.g., plural batteries 50, 52, unless electrical power source 50 has substantial length, e.g., as in an elongated battery pack 50 or other plural battery cell package, wherein plural inward deflections 122 in springs 120 may also be provided.

Where sleeve 100" is intended to provide one or more electrical conductors along the length of barrel 22 as well as to position electrical power source 50, 52 within barrel 22, sleeve 100" is of an electrically conductive material and elongated spring members 120 thereof need to be of sufficient length to make electrical connections near the rear end of barrel 22 and near the forward end of barrel 22, as described above. Thus, elongated spring members 120 are typically of sufficient length to urge electrical power source 50, 52 toward a central position within barrel 22, and so typically are longer than or the same length as electrical power source 50. Electrical connections near the rear end of barrel 22 may be made to, e.g., barrel 22, tail cap 26 and/or switch 24 thereat, and near the forward end of barrel 22 may be made to, e.g., barrel 22 and/or coupling 39.

Optionally, wall 110" of hollow sleeve 100" may have a hole 116 proximate each of the respective longitudinal edges thereof that are moved together when the flat blank of hollow sleeve 100" is formed so that wall 110" thereof is formed into a tubular shape, e.g., into a cylindrical tubular shape. These holes 116 may be utilized for gripping the flat blank when forming it around a mandrel or other shape defining object employed to define the shape of hollow sleeve 100" or for inserting and/or removing it from inside barrel 22 of portable light 10. Similar holes 116 may be provided on the walls 110 of any of hollow sleeves 100.

Figures 9, 9A:
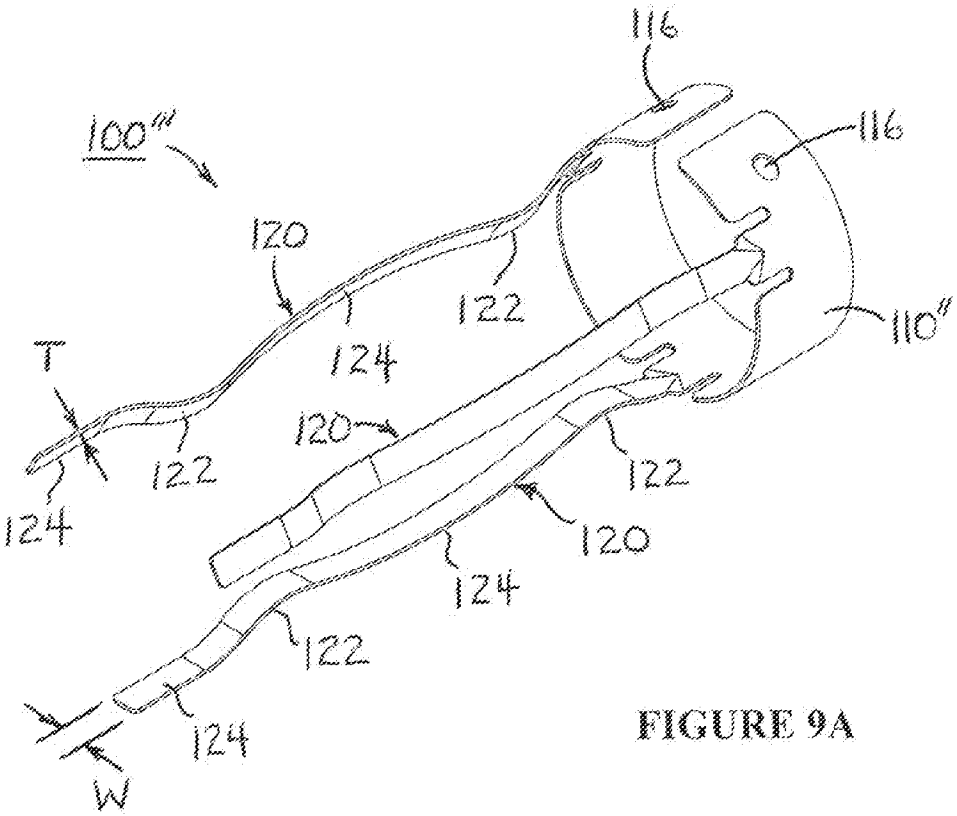
FIG. 9 includes FIGS. 9A and 9B which are a perspective view and a plan view, respectively, of a variation of the alternative example embodiment of a sleeve for a portable light of FIG. 7.
Figure 9B:
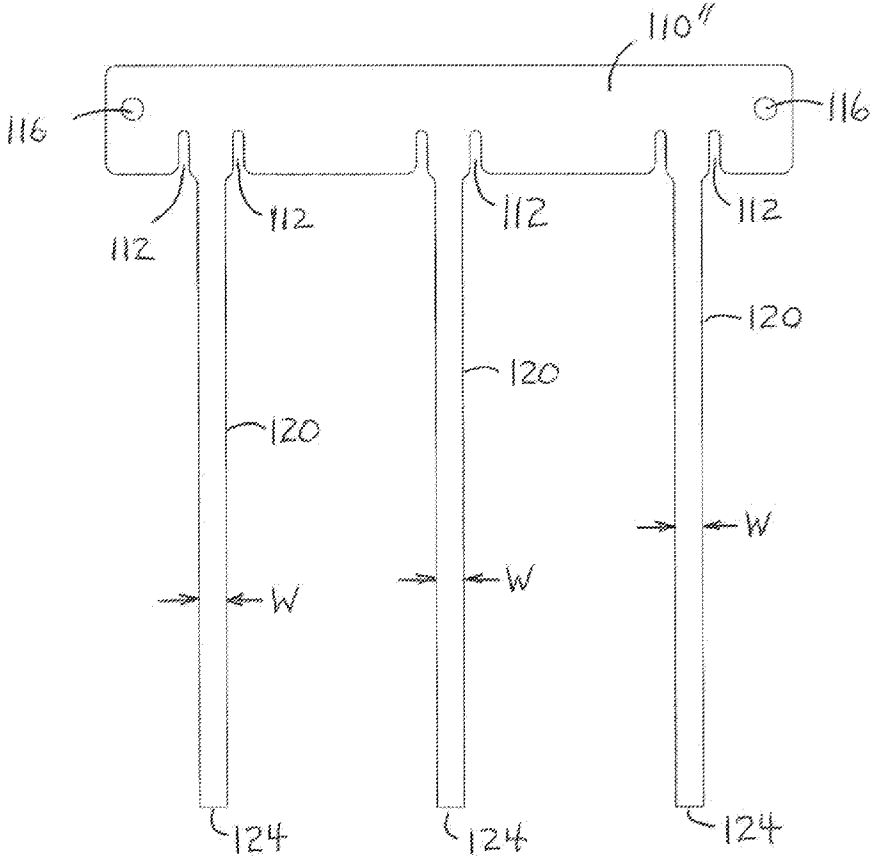

FIG. 9 includes FIGS. 9A and 9B which are a perspective view and a plan view, respectively, of a variation of the alternative example embodiment of a sleeve 100'" for a portable light 10 of FIG. 7. In this variation, elongated longitudinal spring members 120 are made relatively narrower in width W and/or relatively thinner in thickness T so as to reduce the compression force retaining the source of electrical power 50, 52 in the barrel 22 of light 10 so that the source of electrical power 50, 52 may be more easily inserted therein and removed therefrom, e.g., by shaking the light 10. Typically, wall 110" is relatively thinner in thickness T, e.g., corresponding to that of elongated longitudinal spring members 120. Otherwise, the sleeve 100'" of FIG. 9 is the substantially the same in configuration and in function as sleeve 100" of FIGS. 7-8 described above.

Figures 10, 10A:
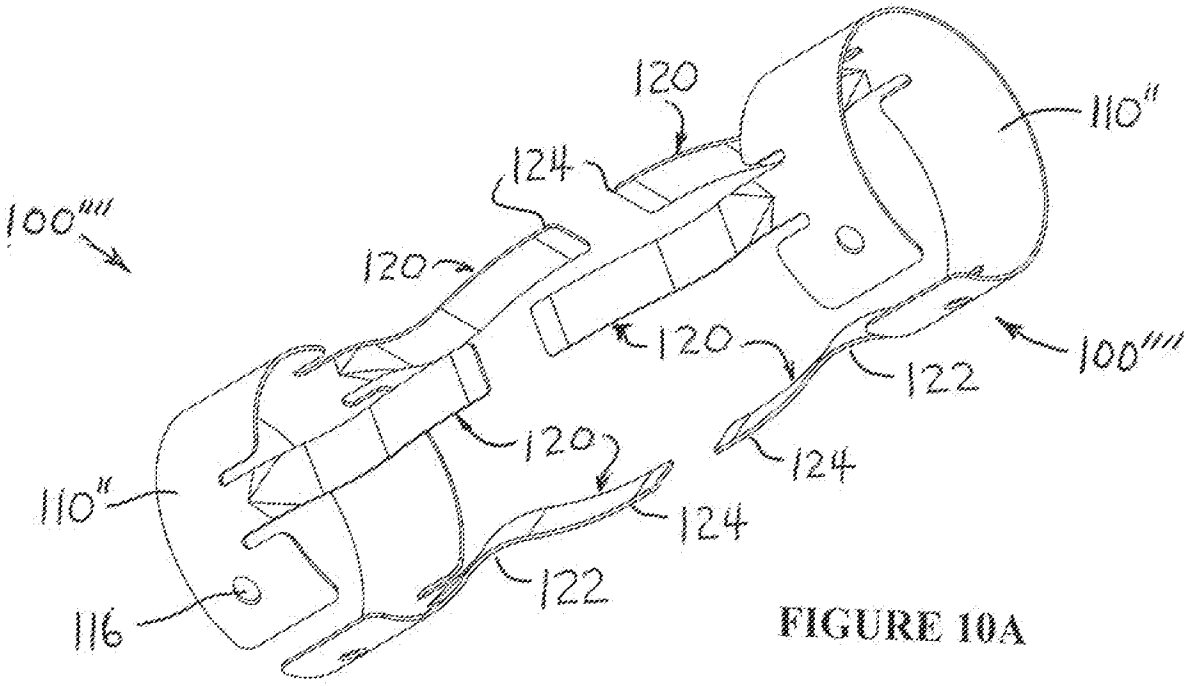
FIG. 10 includes FIGS. 10A and 10B which are a perspective view and a plan view, respectively, of another alternative example embodiment of a sleeve for a portable light.
Figure 10B:
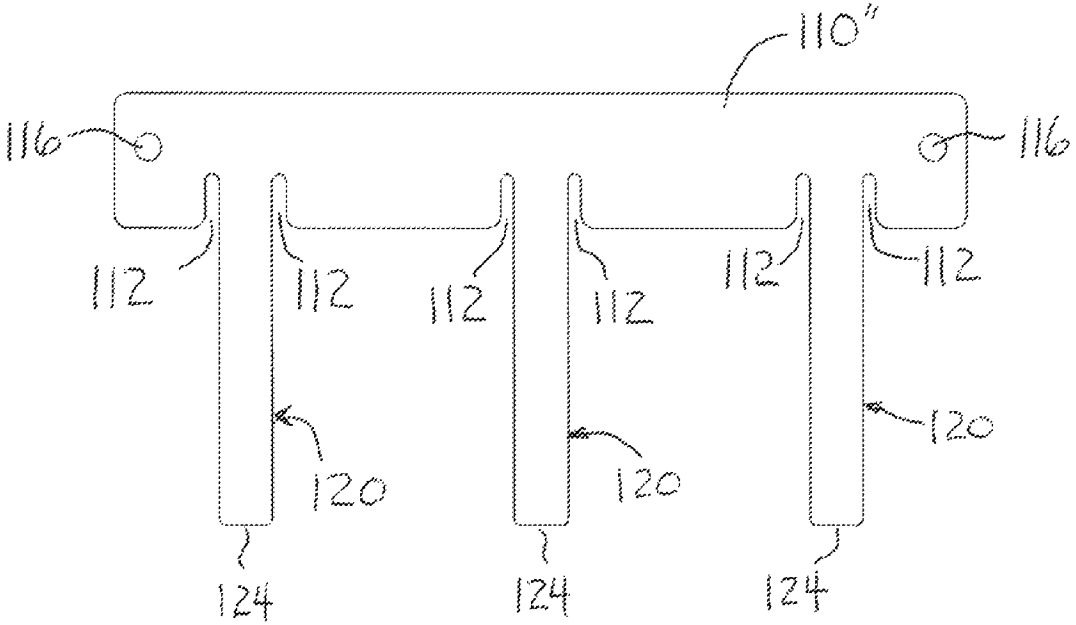
Figure 11:
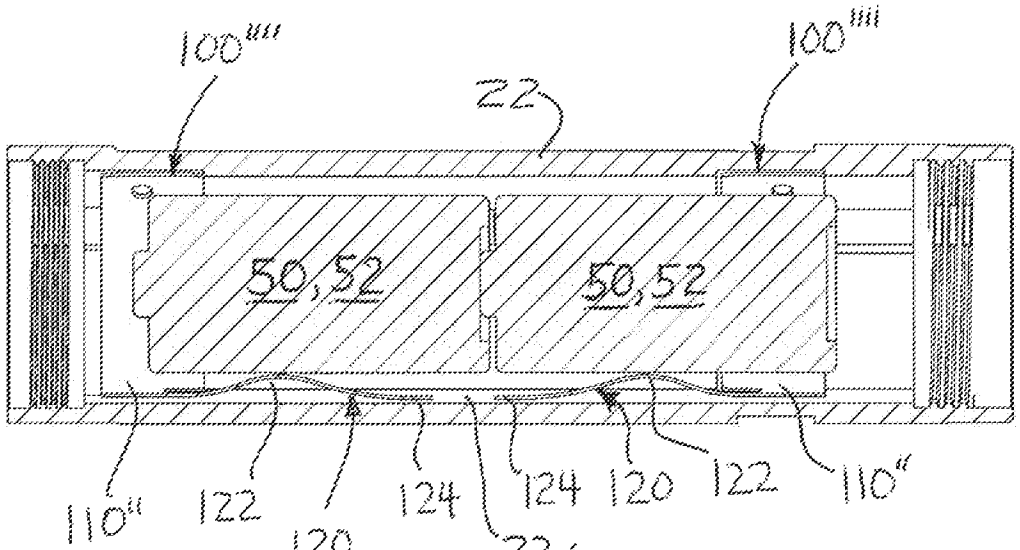
FIG. 11 is a longitudinal cross-sectional view of part of the example portable light having the example sleeve of FIG. 10 therein with a power source therein.

FIG. 10 includes FIGS. 10A and 10B which are a perspective view and a plan view, respectively, of another alternative example embodiment of a sleeve 100"" for a portable light 10; and FIG. 11 is a longitudinal cross-sectional view of part of the example portable light 10 having the example sleeve 100"" of FIG. 10 therein with a power source 50, 52 therein. A pair of sleeves 100"" are typically utilized in an axially adjacent coaxial configuration wherein the distal ends 124 of their respective elongated longitudinal spring members 120 are adjacent to each other, thereby to together serve the same function as do any of the other sleeves 100, 100', 100", and 100'" described herein.

Typically, each elongated longitudinal spring member 120 of sleeves 100"" is shorter in length than its counterpart members in the other sleeves 100, 100', 100", and 100' described herein and may have fewer inward and outward serpentine deflections. Example sleeves 100"" have plural elongated longitudinal spring members 120, typically three, extending axially (longitudinally) from wall 100" that are seen to have one inwardly directed portion 122 and one outwardly directed portion 124, preferably near the distal end thereof. Accordingly, a pair of sleeves 100"" have plural inward portions 122 and plural outward portions 124 similarly to the other embodiments herein with the latter being distal from wall member 110" from which they extend longitudinally. Preferably outward portion 124 is distal from wall 110" so that the distal end thereof can reside in a groove 22*g* in barrel 22 of light housing 20 as described.

Otherwise, the sleeve 100"" of FIG. 10 is the substantially the same in configuration and in function as sleeves 100, 100', 100" and 100'" described above.

In each of the foregoing embodiments of sleeve 100, 100', 100", 100'", and 100"", the elongated longitudinal spring members 120 have a length that is at least one half of the longitudinal length of the one or more sources of electrical power. In each of the foregoing embodiments of sleeve 100", 100'", and 100"", the elongated longitudinal spring members 120 have a length that is longer than the axial length of the wall 110".

Figures 12, 12A:
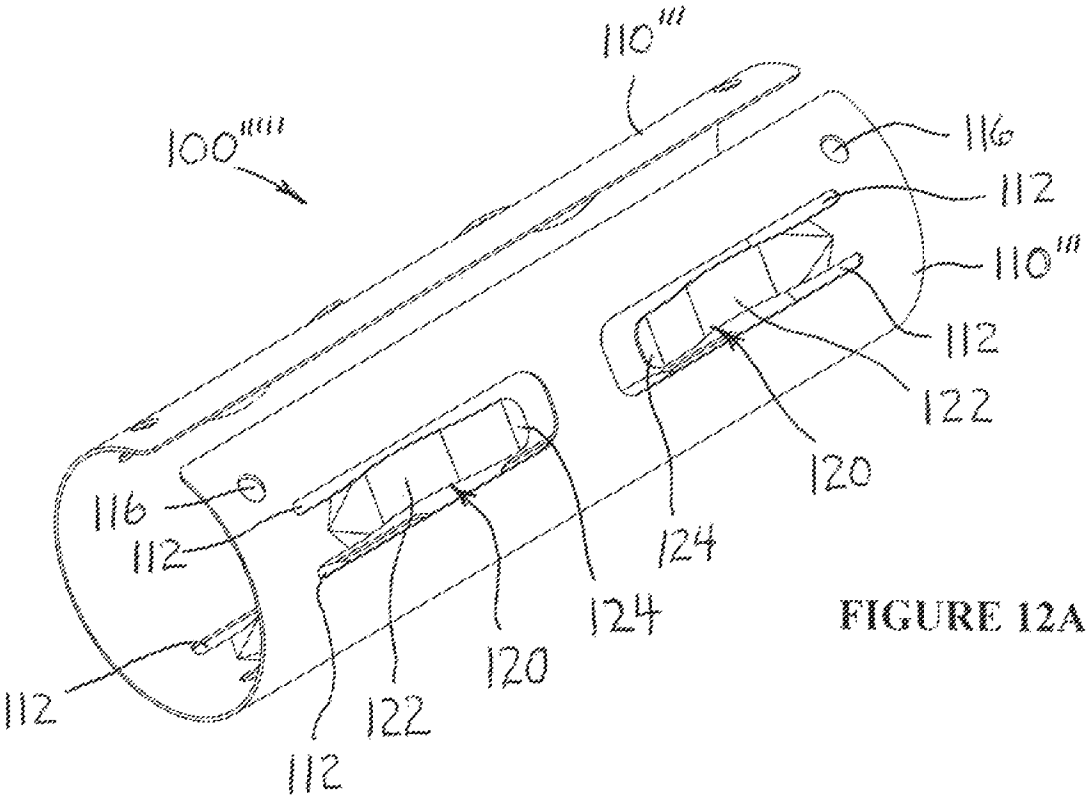
FIG. 12 includes FIGS. 12A and 12B which are a perspective view and a plan view, respectively, of yet another alternative example embodiment of a sleeve for a portable light.
Figure 12B:
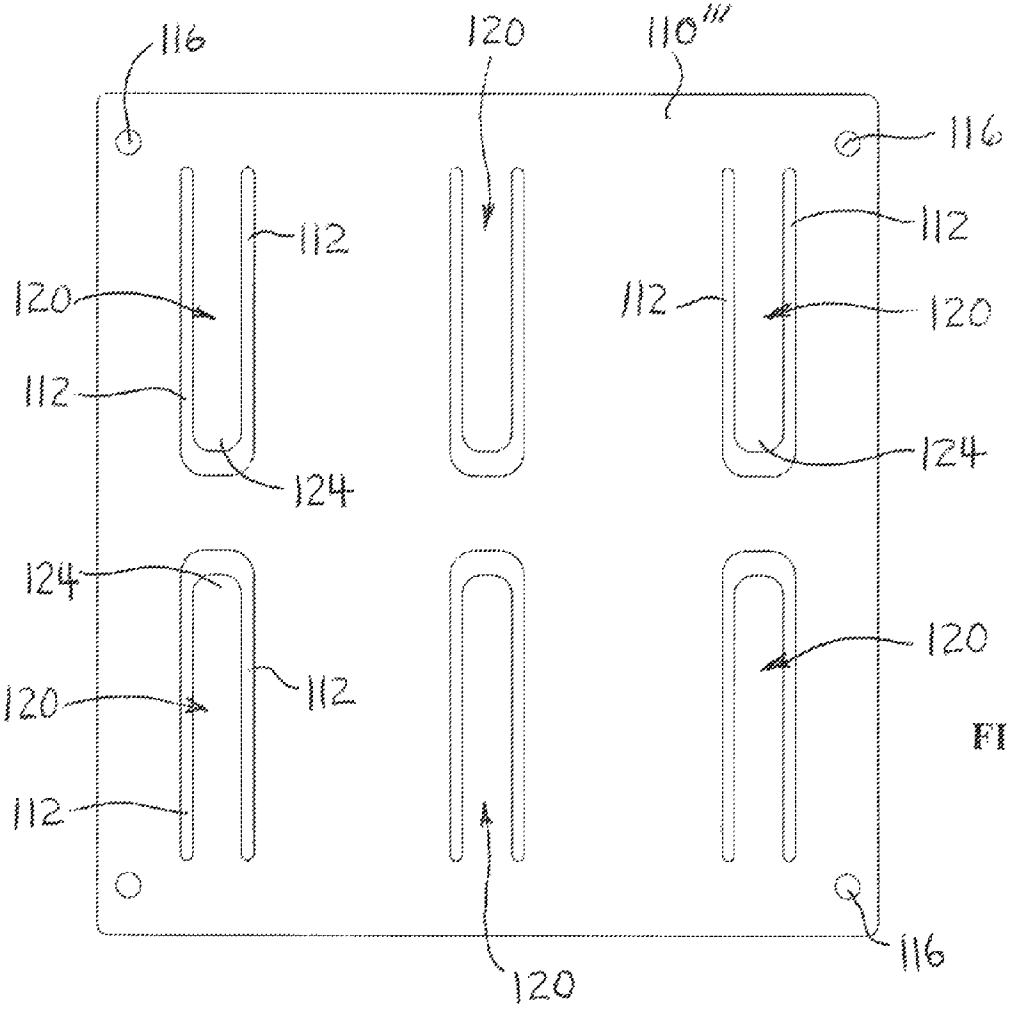
Figure 13:
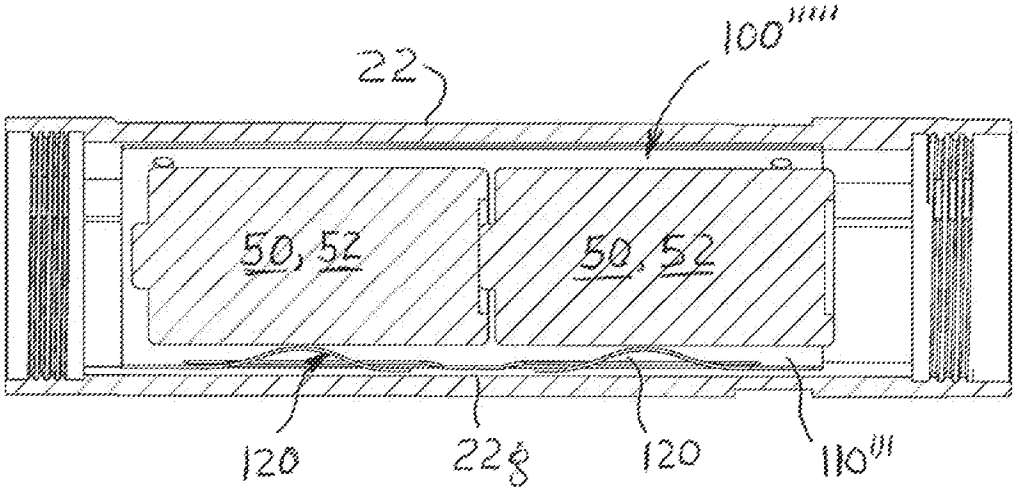
FIG. 13 is a longitudinal cross-sectional view of part of the example portable light having the example sleeve of FIG. 12 therein with a power source therein.

FIG. 12 includes FIGS. 12A and 12B which are a perspective view and a plan view, respectively, of yet another alternative example embodiment of a sleeve 100""" for a portable light 10; and FIG. 13 is a longitudinal cross-sectional view of part of the example portable light 10 having the example sleeve 100""" of FIG. 12 therein with a power source 50, 52, e.g., of smaller diameter therein. Sleeve 100""" differs from sleeves 100, 100', 100", 100'", and 100"" described above in that cylindrical wall 100'" extends the full length thereof.

Sleeve 100'" has a wall 100'" in which are made six U-shaped slots 112 that define six respective longitudinal spring members 120, typically but not necessarily with two sets of three U-shaped slots 112 and the longitudinal spring members 120 they define spaced about 120° apart around the cylinder of wall 110'", with the two sets of slots 112 and spring members 120 spaced apart longitudinally in wall 100'". Each longitudinal spring member 120 has an inwardly extending portion 122 and an outwardly extending portion, the latter preferably being at the distal end of longitudinal spring member 120.

Accordingly, a sleeve 100"" has plural inward portions 122 and plural outward portions 124 similarly to the other embodiments herein with the latter being distal from wall member 110'" from which they extend longitudinally. Preferably outward portion 124 is distal from wall 110'" so that the distal end thereof can reside in an optional groove 22*g* which may be provided in the interior wall of barrel 22 of light housing 20 as described.

When sleeve 100""" is placed into barrel 22 of light housing 20, longitudinal spring members 120 may be disposed in optional longitudinal grooves 22*g*, although barrel 22 need not have grooves 22*g*. Power source 50, e.g., batteries 52, are disposed interior to sleeve 100""" and are located and maintained in a generally central radial position by the radially inward forces directed against power source 50, 52 by longitudinal spring members 120.

Otherwise, the sleeve 100""" of FIG. 12 is the substantially the same in configuration and in function as sleeves 100, 100', 100", 100'", and 100"" described above.

Figures 14, 14A:
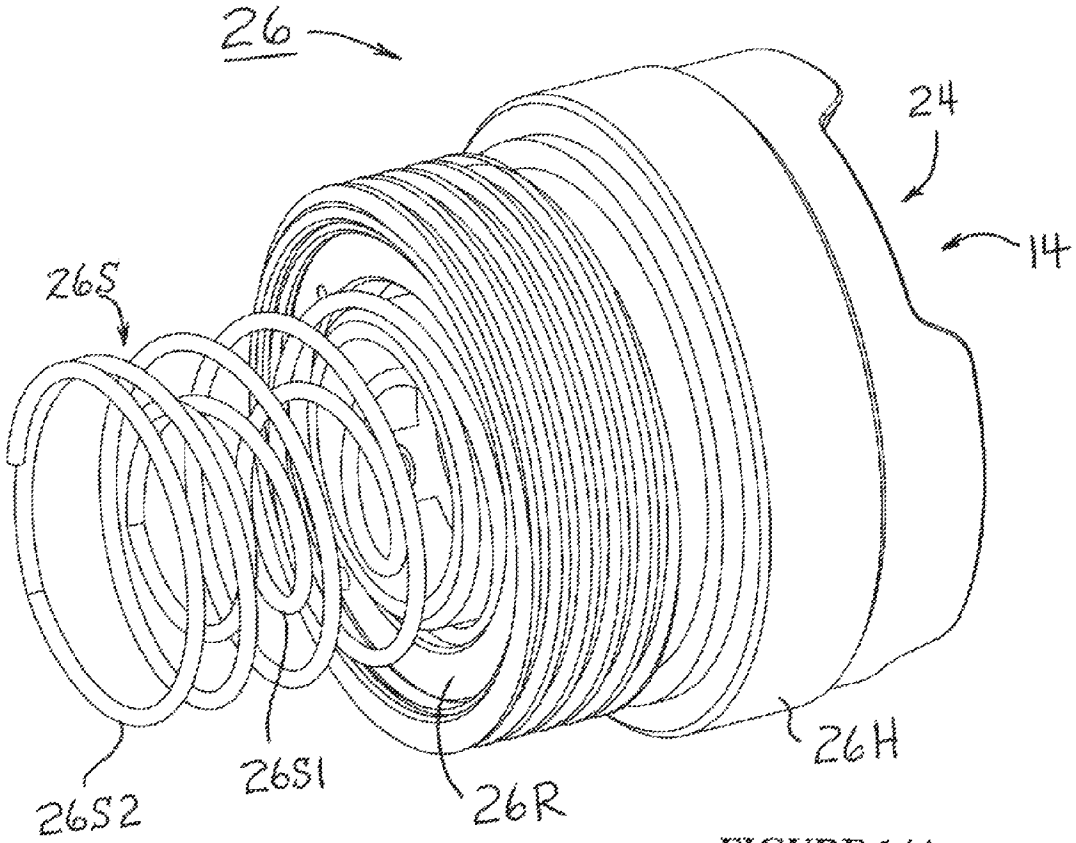
FIG. 14 includes FIGS. 14A and 14B which are a perspective view and a cross-sectional view, respectively, of an example of a tail cap for the example portable light of FIGS. 1 and 2.
Figure 14B:
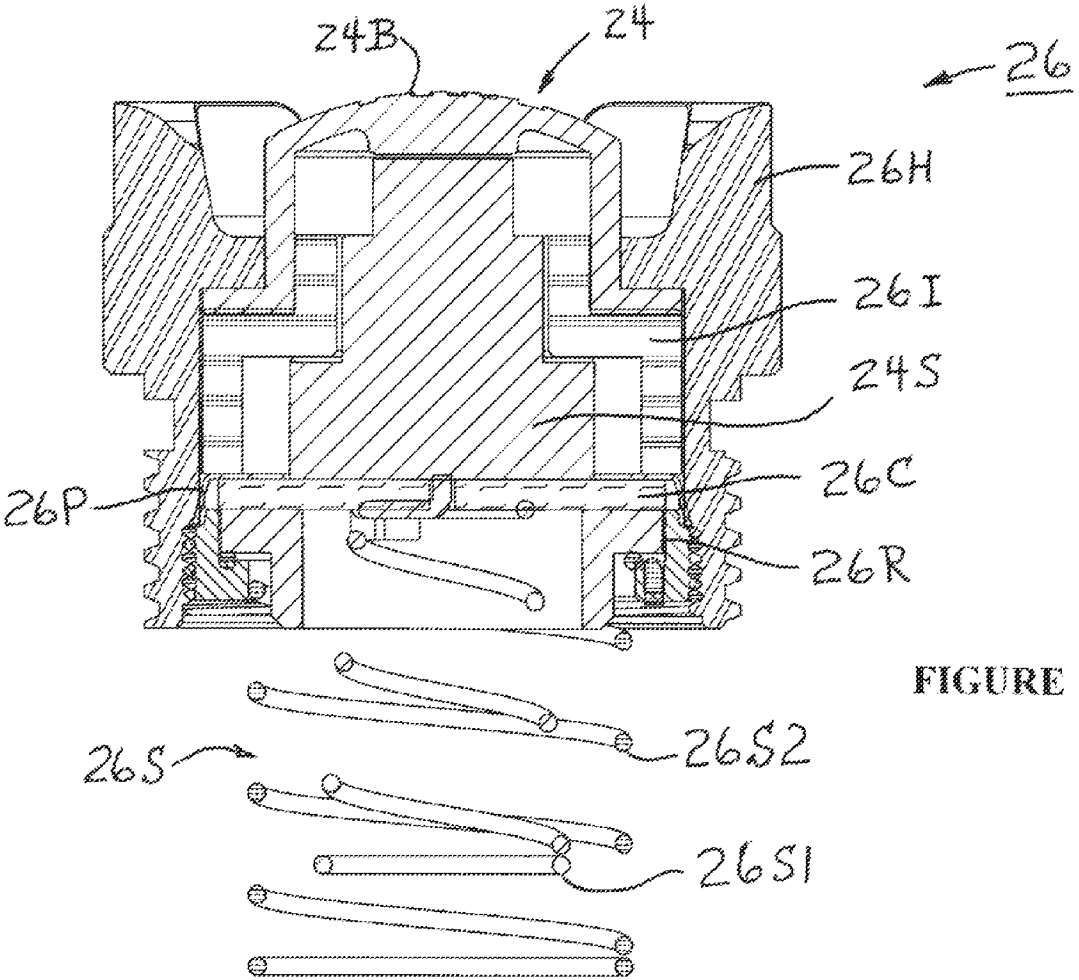

FIG. 14 includes FIGS. 14A and 14B which are a perspective view and a cross-sectional view, respectively, of an example of a tail cap 26 for the example portable light 10 of FIGS. 1 and 2. Tail cap 26 includes a housing 26H having external threads that thread into corresponding internal threads on the interior surface at the rear end 14 of barrel 22 of housing 20. Tail cap 26 includes a switch 24 which includes an electrical switch 24S interior to tail cap 26, the actuator of which is accessible through the opening and/or recess at the rear end 14 of tail cap 26 and is covered by a resilient or flexible cover or boot 24B that provides a seal. Boot 24B is shaped like a top hat having a flexible crown through which electrical switch 24S may be actuated, a cylindrical portion joining the crown to an annular brim which abuts a shoulder on the inside of tail cap housing 26H.

Electrical switch 24S is preferably mounted on an electrical circuit board 26C having a generally circular periphery that corresponds to the generally circular cross-section of the generally cylindrical cavity interior to tail cap housing 26H. Circuit board 2C, switch 24S and boot or cover 26B are retained in tail cap housing 26H by a retaining ring 26R that threads into the cylindrical cavity thereof. Connection pin 26P provides an electrical connection between circuit board 26C, and e.g., switch 24S thereon, and tail cap housing 26H which in turn makes electrical contact with barrel 22 and light housing 20. A centering insert 261 in tail cap housing 26H has a larger diameter portion that surrounds the housing of electrical switch 24S and a smaller diameter portion that fits inside part of the inner surface of the cylindrical portion of actuator boot 24B to position actuator boot 24B and electrical switch axially and radially in tail cap housing 26H.

Two helical springs 26S that preferably are substantially coaxial (or concentric) with each other and with tail cap housing 26H extend forwardly from tail cap 26 into the barrel 22 of light housing 20. The two springs 26S have different coil diameters and numbers of turns, and may be formed of a rod or wire of different materials and/or different diameters, so that they have different spring rates or spring constants.

In the example tail cap 26 shown, inner helical spring 26S1 is, e.g., supported by and makes an electrical connection to circuit board 26C, and, e.g., to switch 24S thereon. Inner helical spring 26S1 extends forwardly into barrel 22, e.g., for making electrical contact with a terminal at the rear end of the one or more sources of electrical power 50, 52 therein. Outer helical spring 26S2 is, e.g., supported by retaining ring 26R and extends forwardly into barrel 22 to exert a bias on the one or more sources of electrical power 50, 52 therein to urge the one or more sources of electrical power 50, 52 forwardly in barrel 22 so that the terminals at the forward end of the one or more sources of electrical power 50, 52 are moved into electrical connection with contact springs 64 of light 10. Typically, the example outer helical spring 26S2 has a higher spring rate than does the example inner helical spring 26S1 which has fewer turns.

While the portable light with which a hollow sleeve 100, 100', 100", 100'", 100"", 100""" (such sleeves may be referred to herein individually and/or collectively as sleeve 100) may be employed may be similar in shape, form and operation, e.g., to a light available from Streamlight, Inc. of Eagleville, Pa., the light 10 described herein is a new light 10 intended for use with hollow sleeve 100. Where sleeve 100 is to provide an electrical connection along the length of barrel 20 of light housing 20, sleeve 100 is preferably of an electrically conductive metal, e.g., a steel, spring steel, stainless steel, bronze, brass, copper, beryllium copper, aluminum, or other suitable metal or electrically conductive non-metal. Where sleeve 100 need not be electrically conductive, sleeve 100 may be of any suitable metal or non-metal, e.g., a plastic such as an engineered acetyl, nylon, nylon, polycarbonate, polyvinyl chloride, polyethylene, polypropylene, polystyrene, ABS, or another suitable plastic material.

Such typical portable light 10 may be about 6.5 inch (about 16.5 cm) in length and about 1.24 inch (about 3.14 cm) in diameter, with an inside barrel 22 diameter of about 0.82 inch (about 2.1 cm), and may utilize a battery pack 50 that includes two lithium-ion type battery cells 52 and is about 0.80 inch (about 2.0 cm) in diameter and about 2.9 inch (about 7.4 cm) in length. Alternatively, plural separate batteries 52 may be employed in lieu of a battery pack 50.

Elongated sleeve 100 of FIG. 3 is preferably formed of about 0.02 inch (about 0.5 mm) thick metal and is about 2.64 inch (about 6.7 cm) in length and about 0.85 inch (about 21.6 mm) in diameter. Elongated springs 120 thereof are about 2.4 inch (about 6.1 cm) in length to extend about 0.08 inch (about 2 mm) beyond the edge of wall 110, are about 0.16 inch (about 4 mm) in width and are formed to have two parts along the length thereof that extend about 0.04 inch (about 1 mm) outside of wall 110 and two parts along the length thereof that extend about 0.08 inch (about 2 mm) inside of wall 110 thereof.

Elongated sleeve 100' of FIG. 6 is preferably formed of about 0.02 inch (about 0.5 mm) thick metal and is about 2.64 inch (about 6.7 cm) in length and about 0.85 inch (about 21.6 mm) in diameter. Elongated springs 120 thereof are about 2.4 inch (about 6.1 cm) in length, about 0.16 inch (about 4 mm) in width and are formed to have two parts along the length thereof that extend about 0.04 inch (about 1 mm) outside of wall 110 and two parts along the length thereof that extend about 0.08 inch (about 2 mm) inside of wall 110 thereof.

Elongated sleeve 100" of FIG. 7 is preferably formed of about 0.008 inch (about 0.2 mm) thick metal and is about 2.64 inch (about 6.7 cm) in length and about 0.85 inch (about 21.6 mm) in diameter. Elongated springs 120 thereof are about 2.4 inch (about 6.1 cm) in length, about 0.16 inch (about 4 mm) in width and are formed to have two parts along the length thereof that extend about 0.04 inch (about 1 mm) outside of wall 110" and two parts along the length thereof that extend about 0.08 inch (about 2 mm) inside of wall 110" thereof. Wall 110" thereof may be about 0.39 inch (about 10 mm) in axial length.

Elongated sleeve 100''' of FIG. 9 is substantially similar to elongated sleeve 100" of FIG. 7 except that the width W of elongated springs 120 thereof is about 0.10 inch (about 0.25 cm) in width. Preferably, the width of elongated springs 120 reduces to the smaller width proximate the end thereof whereat elongated springs 120 join to wall 110".

Each elongated sleeve 100'''' of FIG. 10 is preferably formed of about 0.02 inch (about 0.5 mm) thick metal and is about 1.2 inch (about 3.05 cm) in length and about 0.85 inch (about 21.6 mm) in diameter. Elongated springs 120 thereof are about 0.80 inch (about 2.0 cm) in length to extend about 0.08 inch (about 2 mm) beyond the edge of wall 110", are about 0.16 inch (about 4 mm) in width and are formed to have two parts along the length thereof that extend about 0.04 inch (about 1 mm) outside of wall 110" and two parts along the length thereof that extend about 0.08 inch (about 2 mm) inside of wall 110" thereof.

Elongated sleeve 100' of FIG. 12 is preferably formed of about 0.02 inch (about 0.5 mm) thick metal and is about 2.64 inch (about 6.7 cm) in length and about 0.85 inch (about 21.6 mm) in diameter. Elongated springs 120 thereof are about 0.80 inch (about 2.0 cm) in length to extend about 0.08 inch (about 2 mm) beyond the edge of wall 110''', are about 0.16 inch (about 4 mm) in width and are formed to have two parts along the length thereof that extend about 0.04 inch (about 1 mm) outside of wall 110''' and two parts along the length thereof that extend about 0.08 inch (about 2 mm) inside of wall 110''' thereof.

A portable light 10 may include a sleeve 100, 100', 100", 100''', 100'''', 100''''' which may comprise: a light housing 20 having a barrel 22 for receiving one or more sources of electrical power 50, 52, the barrel 22 having an interior dimension that is larger than an external dimension of the one or more sources of electrical power 50, 52; a light source 40 supported by the light housing 20 for providing light; an electrical circuit for selectively applying electrical power from the one or more sources of electrical power 50, 52 to the light source 40 to produce light; a hollow sleeve 100, 100', 100", 100''', 100'''', 100''''' disposed in the barrel 22 of the light housing 20 to surround at least part of the one or more sources of electrical power 50, 52 the hollow sleeve 100, 100', 100", 100''', 100'''', 100''' having a wall 110, 110', 110", 110''' and a plurality of elongated longitudinal spring members 120 extending therefrom, wherein only one end of each of the elongated longitudinal spring members 120 is connected to the wall 110, 110', 110", 110''' of the hollow sleeve 100, 100', 100", 100''', 100'''', 100''''' and an opposite end 124 thereof is free, wherein each of the elongated longitudinal spring members 120 is formed to partly extend in a radial direction outward of the hollow sleeve 100, 100', 100", 100''', 100'''', 100''''' and to partly extend in a radial direction inward of the hollow sleeve 100, 100', 100", 100''', 100'''', 100''''', and wherein the dimension in a radial direction between the part 124 formed to extend outward and the part 122 formed to extend inward is at least as large as the difference between the interior dimension of the barrel 22 of the light housing 20 and the external dimension of the one or more sources of electrical power 50, 52 50, 52. The wall 110, 110', 110", 110''' of hollow sleeve 100, 100', 100", 100''', 100'''', 100''''' may have a plurality of pairs of longitudinal slots 112 defining at least a part of the plurality of elongated longitudinal spring members 120. Where the barrel 22 is cylindrical, wall 110, 110', 110", 110''' of hollow sleeve 100, 100', 100", 100''', 100'''', 100''''' may be a cylindrical tube; or may be a cylindrical tube having a rim flange 114 at one end thereof. The hollow sleeve 100, 100', 100", 100''', 100'''', 100''''' may have two pairs of longitudinal slots 112 defining at least part of two elongated longitudinal spring members 120 not substantially 180° apart around the hollow sleeve 100, 100', 100", 100''', 100'''', 100'''''; or the hollow sleeve 100, 100', 100", 100''', 100'''', 100''''' may have at least three pairs of longitudinal slots 112 defining at least part of three elongated longitudinal spring members 120 spaced apart around the hollow sleeve 100, 100', 100", 100''', 100'''', 100'''''; or the hollow sleeve 100, 100', 100", 100''', 100'''', 100''''' may have three pairs of longitudinal slots 112 defining at least part of three elongated longitudinal spring members 120 spaced substantially 120° apart around the hollow sleeve 100, 100', 100", 100''', 100'''', 100'''''. Each of the elongated longitudinal spring members 120 may be formed into a serpentine shape. Each of the elongated longitudinal spring members 120 may be formed into a serpentine shape with: at least one part 122 that extends in the radial direction inward of the hollow sleeve 100, 100', 100", 100''', 100'''', 100''''' and at least one part 124 that extends in the radial direction outward of the hollow sleeve 100, 100', 100", 100''', 100'''', 100'''''; or at least two parts 122, 124 that extend in one radial direction relative to said hollow sleeve 100, 100', 100", 100''', 100'''', 100''''' alternately with at least one part 124, 122 that extends in the other radial direction relative to said hollow sleeve 100, 100', 100", 100''', 100'''', 100'''''. Each of the elongated longitudinal spring members 120 has a length that may be: at least one half of the longitudinal length of the hollow sleeve 100, 100', 100", 100''', 100'''', 100'''''; or at least three quarters of the longitudinal length of the hollow sleeve 100, 100', 100", 100''', 100'''', 100'''''; or at least eighty-five percent of the longitudinal length of the hollow sleeve 100, 100', 100", 100''', 100'''', 100'''''. The free end 124 of each of the elongated longitudinal spring members 120 may extend beyond an end of the hollow sleeve 100, 100', 100", 100''', 100'''', 100''''' or may not extend beyond the end of the hollow sleeve 100, 100', 100", 100', 100''', 100''''. The hollow sleeve 100, 100', 100", 100''', 100'''', 100''''' may be of an electrically conductive material and may provide an electrical connection of the electrical circuit. The free end 124 of each of the elongated longitudinal spring members 120 may provide an electrical connection to the light housing 20 or may extend beyond the end of the wall of the hollow sleeve 100, 100', 100", 100''', 100'''', 100''''' and may provide an electrical connection to the light housing 20. The wall 110, 110', 110", 110''' of hollow sleeve 100, 100', 100", 100''', 100'''', 100''''' may have a plurality of pairs of longitudinal slots 112 defining at least a part of the plurality of elongated longitudinal spring members 120; or may have an axial length that is shorter than the elongated longitudinal spring members or that is longer than the elongated longitudinal spring members; or may have a plurality of pairs of longitudinal slots 112 defining at least a part of the plurality of elongated longitudinal spring members 120 and an axial length that is shorter than the elongated longitudinal spring members 120 or that is longer than the elongated longitudinal spring members. Each of the elongated longitudinal spring members 120: may be disposed at least in part in a longitudinal groove 22*g* in the interior surface of the barrel 22; or may provide an electrical connection to the light housing 20; or may extend beyond the end of the wall 110, 110', 110", 110''' of the hollow sleeve 100, 100', 100", 100''', 100'''', 100''''' and may provide an electrical connection to the light housing 20; or any combination of the foregoing.

A sleeve 100, 100', 100", 100''', 100'''', 100''''' for a portable light 10 that includes a light housing 20 having a barrel 22 for receiving one or more sources of electrical power 50, 52, the barrel 22 having an interior dimension that is larger than an external dimension of the one or more sources of electrical power 50, 52; the sleeve 100, 100', 100", 100''', 100'''', 100''''' may comprise: a hollow sleeve 100, 100', 100", 100''', 100'''', 100''''' disposable in a barrel 22 of a light housing 20 to surround at least part of one or more sources of electrical power 50, 52, the hollow sleeve 100, 100', 100", 100''', 100'''', 100''''' having a wall 110, 110', 110", 110''' and a plurality of elongated longitudinal spring members 120 extending therefrom, the hollow sleeve 100, 100', 100", 100''', 100'''', 100''''' optionally having a plurality of pairs of longitudinal slots 112 defining at least part of a plurality of elongated longitudinal spring members 120, wherein only one end of each of the elongated longitudinal spring members 120 is connected to the wall 110, 110', 110", 110''' of the hollow sleeve 100, 100', 100", 100''', 100'''', 100''''' and an opposite end 124 thereof is free, wherein each of the elongated longitudinal spring members 120 may be formed to partly extend in a radial direction outward of the hollow sleeve 100, 100', 100", 100''', 100'''', 100''''' and to partly extend in a radial direction inward of the hollow sleeve 100, 100', 100", 100''', 100'''', 100''''', and wherein the dimension in a radial direction between the part 124 formed to extend outward and the part 122 formed to extend inward may be at least as large as the difference between the interior dimension of the barrel 22 of the light housing 20 and the external dimension of the one or more sources of electrical power 50, 52. The wall 110, 110', 110", 110''' of hollow sleeve 100, 100', 100", 100''', 100'''', 100''''' may have a plurality of pairs of longitudinal slots 112 defining at least a part of the plurality of elongated longitudinal spring members 120. The wall 110, 110', 110", 110''' of hollow sleeve 100, 100', 100", 100''', 100'''', 100''''' may be: a cylindrical tube; or a cylindrical tube having a rim flange 114 at one end thereof. The hollow sleeve 100, 100', 100", 100''', 100'''', 100''''' may have two pair of longitudinal slots 112 defining two elongated longitudinal spring members 120 not substantially 180° apart around the hollow sleeve 100, 100', 100", 100''', 100'''', 100'''''; or may have at least three pair of longitudinal slots 112 defining at least three elongated longitudinal spring members 120 spaced apart around the hollow sleeve 100, 100', 100", 100''', 100'''', 100'''''; or may have three pair of longitudinal slots 112 defining three elongated longitudinal spring members 120 spaced substantially 120° apart around the hollow sleeve 100, 100', 100", 100''', 100'''', 100'''''. Each of the elongated longitudinal spring members 120 may be formed into a serpentine shape. Each of the elongated longitudinal spring members 120 may be formed into a serpentine shape with: at least one part 122 that extends in the radial direction inward of the hollow sleeve 100, 100', 100", 100''', 100'''', 100''''' and at least one part 124 that extends in the radial direction outward of the hollow sleeve 100, 100', 100", 100''', 100'''', 100'''''; or at least two parts 122, 124 that extend in one radial direction relative to said hollow sleeve 100, 100', 100", 100''', 100'''', 100''''' alternately with at least one part 124, 122 that extends in the other radial direction relative to said hollow sleeve 100, 100', 100", 100''', 100'''', 100'''''. Each of the elongated longitudinal spring members 120 may have a length that may be: at least one half of the longitudinal length of the hollow sleeve 100, 100', 100", 100''', 100'''', 100'''''; or at least three quarters of the longitudinal length of the hollow sleeve 100, 100', 100", 100''', 100'''', 100'''''; or at least eighty-five percent of the longitudinal length of the hollow sleeve 100, 100', 100", 100''', 100'''', 100'''''. The free end 124 of each of the elongated longitudinal spring members 120 may extend beyond an end of the wall of the hollow sleeve 100, 100', 100", 100''', 100'''', 100'''''. The hollow sleeve 100, 100', 100", 100''', 100'''', 100''''' may be of an electrically conductive material and may be configured to provide an electrical connection of the light. The wall 110, 110', 110", 110''' of hollow sleeve 100, 100', 100", 100''', 100'''', 100''''' may have a plurality of pairs of longitudinal slots 112 defining at least a part of the plurality of elongated longitudinal spring members 120; or may have an axial length that is shorter than the elongated longitudinal spring members or that is longer than the elongated longitudinal spring members; or may have a plurality of pairs of longitudinal slots 112 defining at least a part of the plurality of elongated longitudinal spring members 120 and an axial length that is shorter than the elongated longitudinal spring members 120 or that is longer than the elongated longitudinal spring members.

A sleeve 100, 100', 100", 100''', 100'''', 100''''' for a portable light 10 that includes a light housing 20 having a barrel 22 for receiving one or more sources of electrical power 50, 52, the barrel 22 having an interior dimension that is larger than an external dimension of the one or more sources of electrical power 50, 52; the sleeve 100, 100', 100", 100''', 100'''', 100''''' may comprise: a hollow sleeve 100, 100', 100", 100''', 100'''', 100''''' of an electrically conductive material disposable in a barrel 22 of a light housing 20 to surround at least part of one or more sources of electrical power 50, 52, the hollow sleeve 100, 100', 100", 100''', 100'''', 100''''' having a wall and at least three elongated longitudinal spring members 120 extending axially therefrom, wherein only one end of each of the elongated longitudinal spring members 120 may be connected to the hollow sleeve 100, 100', 100", 100''', 100'''', 100''''' and an opposite end 124 thereof may be free, wherein each of the elongated longitudinal spring members 120 may have a length that may be at least three quarters of the longitudinal length of the hollow sleeve 100, 100', 100", 100''', 100'''', 100''''', wherein each of the elongated longitudinal spring members 120 may be formed in a serpentine shape to partly extend in at least one place in a radial direction outward of the hollow sleeve 100, 100', 100", 100''', 100'''', 100''''' and to partly extend in at least one place in a radial direction inward of the hollow sleeve 100, 100', 100", 100''', 100'''', 100''''', and wherein the dimension in a radial direction between the part 124 formed to extend outward and the part 122 formed to extend inward may be at least as large as the difference between the interior dimension of the barrel 22 of the light housing 20 and the external dimension of the one or more sources of electrical power 50, 52. The wall 110, 110', 110", 110''' of hollow sleeve 100, 100', 100", 100''', 100'''', 100''''' may have at least three pairs of longitudinal slots 112 defining at least a part of the at least three elongated longitudinal spring members 120; or may have an axial length that is shorter than the elongated longitudinal spring members or that is longer than the elongated longitudinal spring members; or may have at least three pairs of longitudinal slots 112 defining at least a part of the at least three elongated longitudinal spring members 120 and an axial length that is shorter than the elongated longitudinal spring members 120 or that is longer than the elongated longitudinal spring members 120. Each of the at least three elongated longitudinal spring members 120 may have a width at an end proximate the wall 110" of the hollow sleeve 100, 100', 100", 100''', 100'''', 100''''' that is greater than its width over a majority of its longitudinal length. Each of the elongated longitudinal spring members 120 may be configured to: be disposed at least in part in a longitudinal groove 22*g* in the interior surface of the barrel 22; or provide an electrical connection to the light housing 20; or extend beyond the end of the wall 110, 110', 110", 110''' of the hollow sleeve 100, 100', 100", 100''', 100'''', 100''''' and provide an electrical connection to the light housing 20; or any combination of the foregoing.

As used herein, the term "about" means that dimensions, sizes, formulations, parameters, shapes and other quantities and characteristics are not and need not be exact, but may be approximate and/or larger or smaller, as desired, reflecting tolerances, conversion factors, rounding off, measurement error and the like, and other factors known to those of skill in the art. In general, a dimension, size, formulation, parameter, shape or other quantity or characteristic is "about" or "approximate" whether or not expressly stated to be such. It is noted that embodiments of very different sizes, shapes and dimensions may employ the described arrangements.

Although terms such as "up," "down," "left," "right," "up," "down," "front," "rear," "side," "end," "top," "bottom," "forward," "backward," "under" and/or "over," "vertical," "horizontal," and the like may be used herein as a convenience in describing one or more embodiments and/or uses of the present arrangement, the articles described may be positioned in any desired orientation and/or may be utilized in any desired position and/or orientation. Such terms of position and/or orientation should be understood as being for convenience only, and not as limiting of the invention as claimed.

The term battery is used herein to refer to an electrochemical device comprising one or more electro-chemical cells and/or fuel cells, and so a battery may include a single cell or plural cells, whether as individual units or as a packaged unit. A battery is one example of a type of an electrical power source suitable for a portable device. Other devices could include fuel cells, super capacitors, solar cells, and the like. Any of the foregoing may be intended for a single use or for being rechargeable or for both Various embodiments of a battery may have one or more battery cells, e.g., one, two, three, four, or five or more battery cells, as may be deemed suitable for any particular device. A battery may employ various types and kinds of battery chemistry types, e.g., a carbon-zinc, alkaline, lead acid, nickel-cadmium (Ni—Cd), nickel-metal-hydride (NiMH) or lithium-ion (Li-Ion) battery type, of a suitable number of cells and cell capacity for providing a desired operating time and/or lifetime for a particular device, and may be intended for a single use or for being rechargeable or for both. Examples may include a three or six cell lead acid battery typically producing about 6 volts or about 12 volts, a three cell Ni—Cd battery typically producing about 3.6 volts, a four cell NiMH battery typically producing about 4.8 volts, a five cell NiMH battery producing about 6 volts, a Li-Ion battery typically producing about 3.5 volts, or a two-cell Li-Ion battery typically producing about 7 volts, it being noted that the voltages produced thereby will be higher when approaching full charge and will be lower in discharge, particularly when providing higher current and when reaching a low level of charge, e.g., becoming discharged.

While the present invention has been described in terms of the foregoing example embodiments, variations within the scope and spirit of the present invention as defined by the claims following will be apparent to those skilled in the art. For example, while the blank from which hollow battery sleeve 100, 100', 100", 100''', 100'''', 100''''' is formed is preferably stamped or otherwise cut out from a sheet of blank material, hollow sleeve 100, 100', 100", 100''', 100'''', 100''''' may be made by machining, cutting, etching, sawing, extruding, molding or any other suitable method.

Hollow sleeve 100, 100', 100", 100''', 100'''', 100''''' may be retained in barrel 22 of housing 20 by friction between serpentine spring member 120 and the interior of barrel 22, by friction providing element such as an O-ring, by rim flange 114, by crimping or another mechanical restraint, by radial compression, by a fastener, by adhesive, or by another suitable arrangement.

While one of certain embodiments of the described sleeve are illustrated as being utilized in a light 10, and two of another embodiment are illustrated as being utilized in a light 10, one or more of any of such sleeves may be employed in a portable light, if desired.

While certain features may be described as a raised feature, e.g., a ridge, boss, flange, projection or other raised feature, such feature may be positively formed or may be what remains after a recessed feature, e.g., a groove, slot, hole, indentation, recess or other recessed feature, is made. Similarly, while certain features may be described as a recessed feature, e.g., a groove, slot, hole, indentation, recess or other recessed feature, such feature may be positively formed or may be what remains after a raised feature, e.g., a ridge, boss, flange, projection or other raised feature, is made.

Each of the U.S. Provisional Applications, U.S. Patent Applications, and/or U.S. Patents, identified herein is hereby incorporated herein by reference in its entirety, for any purpose and for all purposes irrespective of how it may be referred to or described herein.

Finally, numerical values stated are typical or example values, are not limiting values, and do not preclude substantially larger and/or substantially smaller values. Values in any given embodiment may be substantially larger and/or may be substantially smaller than the example or typical values stated.

What is claimed is:

1. A portable light including a sleeve comprising:

a light housing having a barrel for receiving one or more sources of electrical power, the barrel having an interior dimension that is larger than an external dimension of the one or more sources of electrical power;

a light source supported by said light housing for providing light;

an electrical circuit for selectively applying electrical power from the one or more sources of electrical power to said light source to produce light;

a hollow sleeve disposed in the barrel of said light housing to surround at least part of the one or more sources of electrical power, said hollow sleeve having a wall and a plurality of elongated longitudinal spring members extending therefrom, wherein only one end of each of said elongated longitudinal spring members is connected to the wall of said hollow sleeve and an opposite end thereof is free, wherein each of said elongated longitudinal spring members is formed to partly extend in a radial direction outward of said hollow sleeve and to partly extend in a radial direction inward of said hollow sleeve, and wherein a dimension in a radial direction between the part formed to extend outward and the part formed to extend inward is at least as large as a difference between the interior dimension of the barrel of said light housing and the external dimension of the one or more sources of electrical power.

2. The portable light of claim 1 wherein the barrel is cylindrical and the wall of said hollow sleeve includes:

a cylindrical tube; or a cylindrical tube having a rim flange at one end thereof.

3. The portable light of claim 1 wherein the wall of said hollow sleeve:

has a plurality of pairs of longitudinal slots therein defining at least part of the plurality of elongated longitudinal spring members; or has an axial length that is shorter than said elongated longitudinal spring members or that is longer than said elongated longitudinal spring members; or has a plurality of pairs of longitudinal slots in the wall thereof defining at least part of the plurality of elongated longitudinal spring members and has an axial length that is shorter than said elongated longitudinal spring members or that is longer than said elongated longitudinal spring members.

4. The portable light of claim 3 wherein:

said hollow sleeve has two pairs of longitudinal slots defining at least part of two elongated longitudinal spring members that are not substantially 180° apart around said hollow sleeve; or said hollow sleeve has at least three pairs of longitudinal slots defining at least part of three elongated longitudinal spring members spaced apart around said hollow sleeve; or said hollow sleeve has three pairs of longitudinal slots defining at least part of three elongated longitudinal spring members spaced substantially 120° apart around said hollow sleeve.

5. The portable light of claim 1 wherein each of said elongated longitudinal spring members is formed into a serpentine shape.

6. The portable light of claim 1 wherein each of said elongated longitudinal spring members is formed into a serpentine shape with:

at least one part that extends in the radial direction inward of said hollow sleeve and at least one part that extends in the radial direction outward of said hollow sleeve; or at least two parts that extend in one radial direction relative to said hollow sleeve alternately with at least one part that extends in the other radial direction relative to said hollow sleeve.

7. The portable light of claim 1 wherein each of said elongated longitudinal spring members has a length that:

is at least one half of the longitudinal length of said hollow sleeve; or is at least three quarters of the longitudinal length of said hollow sleeve; or is at least eighty-five percent of the longitudinal length of said hollow sleeve; or is substantially longer than is the wall of said hollow sleeve.

8. The portable light of claim 1 wherein the free end of each of said elongated longitudinal spring members extends beyond an end of said hollow sleeve or does not extend beyond the end of said hollow sleeve.

9. The portable light of claim 1 wherein said hollow sleeve is of an electrically conductive material and provides an electrical connection of said electrical circuit.

10. The portable light of claim 1 wherein each of said elongated longitudinal spring members:

is disposed at least in part in a longitudinal groove in the interior surface of the barrel; or provides an electrical connection to said light housing; or extends beyond the end of the wall of said hollow sleeve and provides an electrical connection to said light housing; or any combination of the foregoing.

11. A sleeve for a portable light that includes a light housing having a barrel for receiving one or more sources of electrical power, the barrel having an interior dimension that is larger than an external dimension of the one or more sources of electrical power;

said sleeve comprising:

a hollow sleeve disposable in a barrel of a light housing to surround at least part of one or more sources of electrical power, said hollow sleeve having a wall and a plurality of elongated longitudinal spring members extending therefrom, wherein only one end of each of said elongated longitudinal spring members is connected to the wall of said hollow sleeve and an opposite end thereof is free, wherein each of said elongated longitudinal spring members is formed to partly extend in a radial direction outward of said hollow sleeve and to partly extend in a radial direction inward of said hollow sleeve, and wherein a dimension in a radial direction between the part formed to extend outward and the part formed to extend inward is at least as large as a difference between the interior dimension of the barrel of the light housing and the external dimension of the one or more sources of electrical power.

12. The sleeve for a portable light of claim 11 wherein the wall of said hollow sleeve is:

a cylindrical tube; or a cylindrical tube having a rim flange at one end thereof.

13. The sleeve for a portable light of claim 11 wherein the wall of said hollow sleeve:

has a plurality of pairs of longitudinal slots therein defining at least part of the plurality of elongated longitudinal spring members; or has an axial length that is shorter than said elongated longitudinal spring members or that is longer than said elongated longitudinal spring members; or has a plurality of pairs of longitudinal slots in the wall thereof defining at least part of the plurality of elongated longitudinal spring members and has an axial length that is shorter than said elongated longitudinal spring members or that is longer than said elongated longitudinal spring members.

14. The sleeve for a portable light of claim 11 wherein:

said hollow sleeve has two pair of longitudinal slots defining at least part of two elongated longitudinal spring members that are not substantially 180° apart around said hollow sleeve; or said hollow sleeve has at least three pair of longitudinal slots defining at least part of three elongated longitudinal spring members spaced apart around said hollow sleeve; or said hollow sleeve has three pair of longitudinal slots defining at least part of three elongated longitudinal spring members spaced substantially 120° apart around said hollow sleeve.

15. The sleeve for a portable light of claim 11 wherein each of said elongated longitudinal spring members is formed into a serpentine shape.

16. The sleeve for a portable light of claim 11 wherein each of said elongated longitudinal spring members is formed into a serpentine shape with:

at least one part that extends in the radial direction inward of said hollow sleeve and at least one part that extends in the radial direction outward of said hollow sleeve; or at least two parts that extend in one radial direction relative to said hollow sleeve alternately with at least one part that extends in the other radial direction relative to said hollow sleeve.

17. The sleeve for a portable light of claim 11 wherein each of said elongated longitudinal spring members has a length that:

is at least one half of the longitudinal length of said hollow sleeve; or is at least three quarters of the longitudinal length of said hollow sleeve; or is at least eighty-five percent of the longitudinal length of said hollow sleeve; or is substantially longer than is the wall of said hollow sleeve.

18. The sleeve for a portable light of claim 11 wherein the free end of each of said elongated longitudinal spring members extends beyond an end of the wall of said hollow sleeve.

19. The sleeve for a portable light of claim 11 wherein said hollow sleeve is of an electrically conductive material and is configured to provide an electrical connection of the light.

20. The portable light of claim 11 wherein the free end of each of said elongated longitudinal spring members is configured to:

provide an electrical connection to said light housing; or extend beyond the end of the wall of said hollow sleeve and provide an electrical connection to said light housing.

21. A sleeve for a portable light that includes a light housing having a barrel for receiving one or more sources of electrical power, the barrel having an interior dimension that is larger than an external dimension of the one or more sources of electrical power;

said sleeve comprising:

a hollow sleeve of an electrically conductive material disposable in a barrel of a light housing to surround at least part of one or more sources of electrical power, said hollow sleeve having a wall and at least three elongated longitudinal spring members extending axially therefrom, wherein only one end of each of said elongated longitudinal spring members is connected to the wall of said hollow sleeve and an opposite end thereof is free, wherein each of said elongated longitudinal spring members has a length that is at least one half of the longitudinal length of the one or more sources of electrical power, wherein each of said elongated longitudinal spring members is formed in a serpentine shape to partly extend in at least one place in a radial direction outward of said hollow sleeve and to partly extend in at least one place in a radial direction inward of said hollow sleeve, and wherein a dimension in a radial direction between the part formed to extend outward and the part formed to extend inward is at least as large as a difference between the interior dimension of the barrel of the light housing and the external dimension of the one or more sources of electrical power.

22. The sleeve for a portable light of claim 21 wherein the wall of said hollow sleeve:

has at least three pairs of longitudinal slots therein defining at least part of the at least three elongated longitudinal spring members; or has an axial length that is shorter than said elongated longitudinal spring members or that is longer than said elongated longitudinal spring members; or has at least three pairs of longitudinal slots in the wall thereof defining at least part of the at least three elongated longitudinal spring members and has an axial length that is shorter than said at least three elongated longitudinal spring members or that is longer than said at least three elongated longitudinal spring members.

23. The sleeve for a portable light of claim 21 wherein each of said at least three elongated longitudinal spring members has a width at an end proximate the wall of said hollow sleeve that is greater than its width over a majority of its longitudinal length.

24. The sleeve for a portable light of claim 21 wherein each of said elongated longitudinal spring members is configured to:

be disposed at least in part in a longitudinal groove in the interior surface of the barrel; or provide an electrical connection to the light housing; or extend beyond the end of the wall of said hollow sleeve and provide an electrical connection to the light housing; or any combination of the foregoing.

* * * * *